US010688790B2

(12) United States Patent
Iida

(10) Patent No.: US 10,688,790 B2
(45) Date of Patent: Jun. 23, 2020

(54) LIQUID JETTING APPARATUS PERFORMING CONTROL BASED ON EVAPORATION AMOUNT OF WATER CONTENT IN LIQUID

(71) Applicant: Brother Kogyo Kabushiki Kaisha, Nagoya-shi, Aichi-ken (JP)

(72) Inventor: Shotaro Iida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/048,635

(22) Filed: Jul. 30, 2018

(65) Prior Publication Data

US 2019/0100013 A1 Apr. 4, 2019

(30) Foreign Application Priority Data

Sep. 29, 2017 (JP) ..... 2017-191409

(51) Int. Cl.
*B41J 2/165* (2006.01)

(52) U.S. Cl.
CPC ..... *B41J 2/16517* (2013.01); *B41J 2/16505* (2013.01); *B41J 2/16508* (2013.01); *B41J 2/16526* (2013.01); *B41J 2002/16573* (2013.01)

(58) Field of Classification Search
CPC ..... B41J 2/16517; B41J 2/16505; B41J 2/16526; B41J 2/16508; B41J 2/16579; B41J 2002/16573
See application file for complete search history.

(56) References Cited

U.S. PATENT DOCUMENTS 6,299,277 B1 * 10/2001 Fujii ..... B41J 2/1652 347/23
8,007,070 B2 8/2011 Kaga et al.
2007/0188544 A1 8/2007 Morikoshi
2008/0143764 A1 6/2008 Kaga et al.
2016/0288506 A1 * 10/2016 Tamaki ..... B41J 2/16508

FOREIGN PATENT DOCUMENTS

JP 2006-159717 A 6/2006
JP 2007-216499 A 8/2007
JP 2008-149527 A 7/2008
JP 2014-104601 A 6/2014
JP 2015-063076 A 4/2015

* cited by examiner

*Primary Examiner* — Scott A Richmond
(74) *Attorney, Agent, or Firm* — Banner & Witcoff, Ltd.

(57) ABSTRACT

There is provided a liquid jetting apparatus including: a liquid jetting head having a nozzle; a supply channel; a cap configured to cover the nozzle; a discharging section; a switching mechanism switching a state of the cap between a capping state and an uncapping state; and a controller. The controller is configured to perform: controlling the discharging section, based on both of a supply evaporation rate according to an evaporation rate of water content in the liquid inside the supply channel and a cap evaporation rate which is an evaporation rate of the water content in the liquid remaining in the cap, so as to cause the liquid to be discharged from the nozzle; and controlling the discharging section, based on one of the supply evaporation rate and the cap evaporation rate, to cause the liquid to be discharged from the nozzle.

13 Claims, 9 Drawing Sheets

| U \ G1 | G1≦G10 | G10<G1≦G11 | G1>G11 |
|---|---|---|---|
| U≦U0 | F11[Ts] | F12[Ts] | F13[Ts] |
| U0<U≦U1 | F21[Ts] | F22[Ts] | F23[Ts] |
| U>U1 | F31[Ts] | F32[Ts] | F33[Ts] |

Fig. 8A

| E | E0 | E1 | E2 | E3 | E4 | E5 |
|---|---|---|---|---|---|---|
| ΔWn | ΔWn0 | ΔWn1 | ΔWn2 | ΔWn3 | ΔWn4 | ΔWn5 |

Fig. 8B

| Dp \ Dc | $Dc \leqq D_C0$ | $D_C0 < Dc \leqq D_C1$ | $Dc > D_C1$ |
|---|---|---|---|
| $Dp \leqq Dp0$ | Dn11 | Dn12 | Dn13 |
| $Dp0 < Dp \leqq Dp1$ | Dn21 | Dn22 | Dn23 |
| $Dp > Dp1$ | Dn31 | Dn32 | Dn33 |

Fig. 8C

| U \ Wn | $Wn \leqq Wn1$ | $Wn1 < Wn \leqq Wn2$ | $Wn > Wn2$ |
|---|---|---|---|
| $U \leqq U0$ | V2 | V2 | V3 |
| $U0 < U \leqq U1$ | V1 | V2 | V2 |
| $U > U1$ | V1 | V1 | V1 |

Fig. 8D

| U \ Dn | $Dn \leqq Dn2$ | $Dn2 < Dn \leqq Dn3$ | $Dn > Dn3$ |
|---|---|---|---|
| $U \leqq U0$ | V2 | V2 | V3 |
| $U0 < U \leqq U1$ | V1 | V2 | V2 |
| $U > U1$ | V1 | V1 | V1 |

LIQUID JETTING APPARATUS PERFORMING CONTROL BASED ON EVAPORATION AMOUNT OF WATER CONTENT IN LIQUID

CROSS REFERENCE TO RELATED APPLICATION

The present application claims priority from Japanese Patent Application No. 2017-191409 filed on Sep. 29, 2017, the disclosures of which are incorporated herein by reference in its entirety.

BACKGROUND

Field of the Invention

The present teaching relates to a liquid jetting apparatus which jets or discharges liquid from a nozzle.

Description of the Related Art

Conventionally, as an example of a liquid jetting apparatus which jets liquid from a nozzle, there is a publicly known ink-jet printer which jets an ink from a nozzle so as to perform printing. In the publicly known ink-jet printer, a purge is performed for causing the ink to be jetted from the nozzle into a cap, in a state that the cap is installed in an ink-jet head. Further, this printer performs a pre-recording flushing for causing the ink to be jetted from the nozzle to an ink receiver such as the cap before performing recording, and a during-recording flushing causing the ink to be jetted from the nozzle to the ink receiver during the recording.

SUMMARY

Here, in a case that any recording is not performed in the ink-jet printer, the cap is installed in the ink-jet head. An ink, remaining in the cap after an empty suction performed after the purge, is present inside the cap. Further, an ink normally contains a humectant for suppressing the evaporation of a water content in the ink. Accordingly, the humectant absorbs the water content in the ink, which in turn causes the water content to move from the ink inside the nozzle to the ink inside the cap, thereby increasing the viscosity of the ink inside the nozzle. Furthermore, the degree or extent of the movement of the water content changes depending on the evaporation rate of the water content in the ink inside the cap and the evaporation rate of the water content in the ink inside the ink-jet head. Therefore, the viscosity of the ink inside the nozzle in a case that the pre-recording flushing is performed is determined based on the evaporation rate of the water content in the ink inside the ink-jet head and the evaporation rate of the water content in the ink inside the cap.

On the other hand, during the recording in the ink-jet printer, the cap is not installed in the ink-jet head, and thus the movement of the water content as described above does not occur. Consequently, the viscosity of the ink inside the nozzle in a case that the during-recording flushing is performed is determined based on the evaporation rate of the water content in the ink inside the ink-jet head, regardless of the evaporation rate of the water content in the ink inside the cap.

Accordingly, provided that any attempt is made to perform control regarding the pre-recording flushing and the during-recording flushing, uniformly based on both of the evaporation rate of the water content in the ink inside the cap and the evaporation rate of the water content in the ink inside the ink-jet head, or perform the control uniformly based only on the evaporation rate of the water content in the ink inside the ink-jet head, there is such a fear that the ink might be discharged, in an amount greater than necessary, in either one of the pre-recording flushing and the during-recording flushing.

Further, also regarding an operation for jetting the ink from the nozzle during the recording (discharging operation, jetting operation) which is different from the pre-recording flushing and the during-recording flushing, provided that any attempt is made to perform control uniformly based on both or one of the evaporation rate of the water content in the ink inside the cap and the evaporation rate of the water content in the ink inside the ink-jet head, there is such a fear that the ink might be discharged, in an amount greater than necessary, in either one of the above-described jetting operations.

Considering the above-described situation, an object of the preset teaching is to provide a liquid jetting apparatus which is capable of preventing a liquid from being discharged (jetted) from a nozzle(s) in an amount that is greater than necessary.

According to a first aspect of the present teaching, there is provided a liquid jetting apparatus including: a liquid jetting head including a nozzle; a supply channel connected to the liquid jetting head to supply liquid to the nozzle; a cap configured to cover the nozzle; a discharging section configured to cause the liquid to be discharged from the nozzle; a switching mechanism configured to perform switching of a state of the cap between a capping state in which the cap is in contact with the liquid jetting head to cover the nozzle and an uncapping state in which the cap is apart from the liquid jetting head; and a controller. The controller is configured to perform: controlling the discharging section to cause the liquid to be discharged from the nozzle, based on both of a supply evaporation rate and a cap evaporation rate, the supply evaporation rate relating to an evaporation rate of a water content in the liquid inside the supply channel, and the cap evaporation rate being an evaporation rate of the water content in the liquid discharged into the cap and remaining in the cap; and controlling the discharging section to cause the liquid to be discharged from the nozzle, based on one of the supply evaporation rate and the cap evaporation rate.

According to a second aspect of the present teaching, there is provided a liquid jetting apparatus including: a liquid jetting head including a nozzle; a supply channel connected to the liquid jetting head to flow liquid being to be supplied to the nozzle; a cap configured to cover the nozzle; a discharging section configured to cause the liquid to be discharged from the nozzle; a switching mechanism configured to perform switching of a state of the cap between a capping state in which the cap is in contact with the liquid jetting head so as to cover the nozzle and an uncapping state in which the cap is apart from the liquid jetting head; and a controller. The controller is configured to perform: controlling one of the liquid jetting head and the discharging section to cause the liquid to be discharged from the nozzle, based on both of a supply evaporation rate and a cap evaporation rate, the supply evaporation rate relating to an evaporation rate of a water content in the liquid inside the supply channel, and the cap evaporation rate being an evaporation rate of the water content in the liquid discharged to the cap and remaining in the cap; and controlling the one of the liquid jetting head and the discharging section to cause the liquid to be discharged from the nozzle, based on one of the supply evaporation rate and the cap evaporation rate.

Provided that any attempt is made to perform control regardless of the kind of the discharging operations, uniformly based on both of the supply evaporation rate and the cap evaporation rate, or perform control uniformly based only one of the supply evaporation rate and the cap evaporation rate, there is such a fear that the liquid might be discharged from the liquid jetting head, in an amount greater than as required, in a part of the discharging operations. The present teaching has a such a configuration capable of performing controlling based on both of the supply evaporation rate and the cap evaporation rate, and the second discharging operation for performing controlling based on only one of the supply evaporation rate and the cap evaporation rate. Namely, whether or not the control is performed based on both of the supply evaporation rate and the cap evaporation rate, and whether or not the control is performed based on only one of the supply evaporation rate and the cap evaporation rate are made different depending on the kind of the discharging operations. By doing so, it is possible to suppress the occurrence of such a situation that the liquid is discharged or jetted from the liquid jetting head in an amount that is greater than necessary, as compared with the above-described cases.

Note that in the present teaching, such a phrase that "the supply channel is connected to the liquid jetting head", etc., means such a configuration or situation wherein the supply channel is connected to a channel inside the liquid jetting head and that the liquid can be supplied from the supply channel to the nozzle. Further, in the present teaching, such a phrase that "the liquid jetting head is controlled" or that "to control the liquid jetting head", etc., encompasses a concept of controlling an actuator, etc., constructing the liquid jetting head and/or of controlling a circuit, etc., connected to the actuator and to an electric circuit.

BRIEF DESCRIPTION OF THE DRAWINGS

FIG. 8A is a view depicting a table in which a purge amount is associated with a lowering amount of the viscosity of the ink inside the ink-jet head lowered due to a suction purge. FIG. 8B is a view depicting a table in which the supply evaporation rate and the cap evaporation rate are associated with a nozzle evaporation rate, FIG. 8C is a view depicting a table in which the supply evaporation rate and the temperature are associated with a driving voltage at a time of printing, and FIG. 8D is a view depicting a table in which the nozzle evaporation rate and the temperature are associated with a driving voltage at a time of a pre-print flushing.

DESCRIPTION OF THE EMBODIMENTS

In the following, an embodiment of the present teaching will be explained, with reference to the drawings as appropriate.

<Overall Configuration of Printer>

Figure 1:
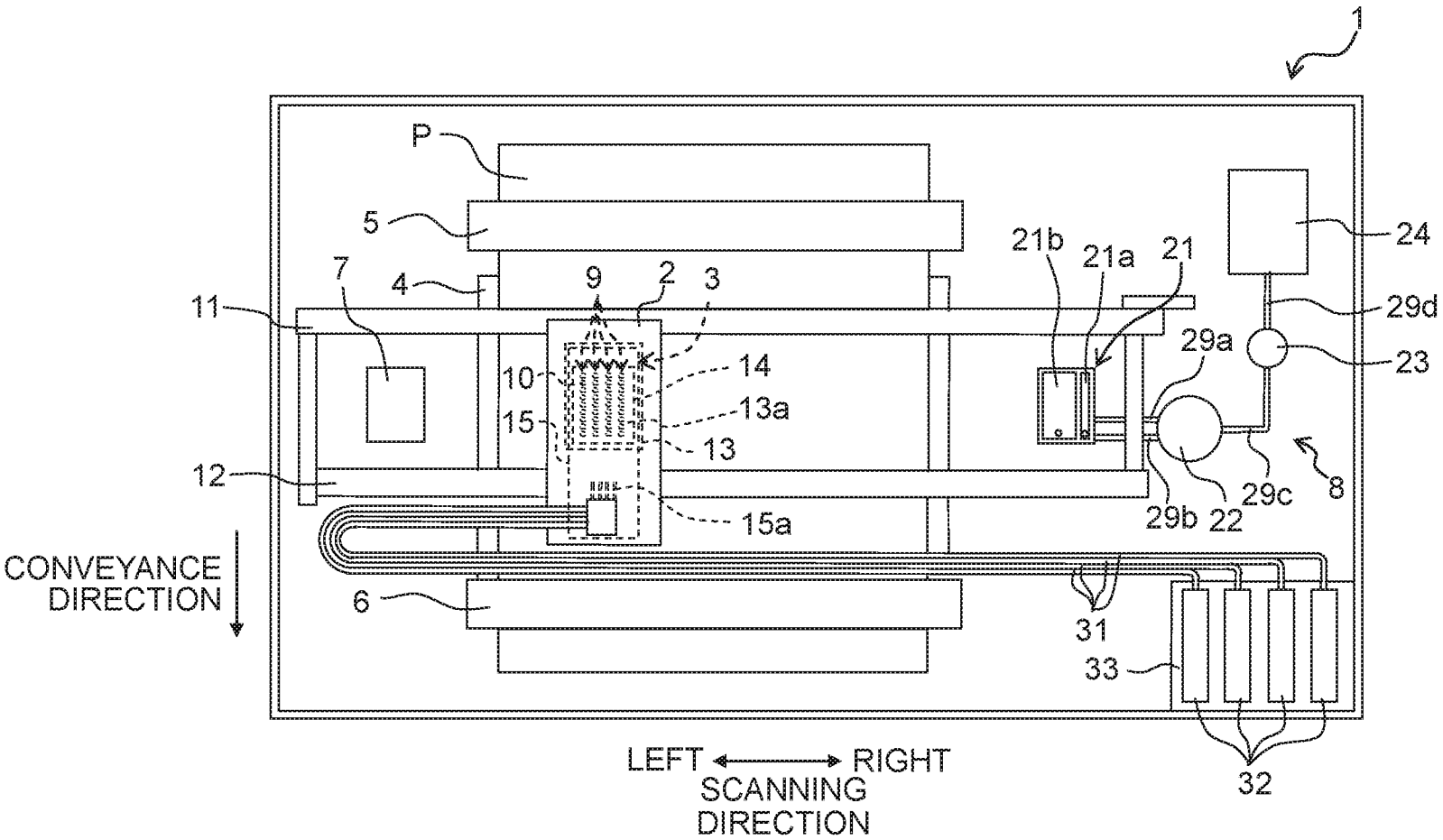
FIG. 1 is a view depicting the schematic configuration of a printer according to an embodiment of the present teaching.

As depicted in FIG. 1, a printer 1 according to an embodiment of the present teaching (corresponding to a "liquid jetting apparatus" of the present teaching) is provided with a carriage 2, an ink-jet head 3 (corresponding to a "liquid jetting head" of the present teaching), a platen 4, conveyance rollers 5 and 6, a flushing foam 7, a maintenance unit 8, etc.

The carriage 2 is supported by two guide rails 1 and 12 extending in a scanning direction. Further, the carriage 2 is connected to a carriage motor 56 (see FIG. 2) via a non-illustrated belt, etc.; in a case that the carriage motor 56 is driven, the carriage 2 is thereby reciprocated in the scanning direction along the guide rails 11 and 12. Note that in the following explanation, the right and left sides in the scanning direction are defined as those depicted in FIG. 1.

The ink-jet head 3 is mounted on the carriage 2. The ink-jet head 3 has a channel unit 13 and an actuator 14. The lower surface of the channel unit 13 is a nozzle surface 13*a* formed with an ink channel including a plurality of nozzles 10 via which an ink is jetted or discharged. The plurality of nozzles 10 are arranged in a row in a conveyance direction orthogonal to the scanning direction to thereby form a nozzle row 9; four nozzle rows 9 are arranged side by side in the scanning direction in the nozzle surface 13*a*. Ink of which colors are black, yellow, cyan and magenta are jetted from the nozzles 10 of the four nozzle rows 9 in this order respectively from a rightmost side nozzle row 9 which is included in the four nozzle rows 9 and which is located at the right side in the scanning direction. The actuator 14 is configured to impart a jetting energy individually to the ink inside each of the nozzles 10. For example, the actuator 14 is configured to change the volume of a pressure chamber (not depicted in the drawings) which communicates with each of the nozzles 10 to thereby impart the pressure to the ink, or is configured to perform heating to thereby generate an air bubble in the pressure chamber and impart the pressure to the ink. However, since the construction of the actuator 14 itself is publicly known, any further detailed explanation for the actuator 14 will be omitted here. Further, an electric power source circuit 49 is connected to the actuator 14. The electric power source circuit 49 is a circuit configured to generate a driving voltage for driving the actuator 14.

Further, the ink-jet head 3 is connected to a sub tank 15. The sub tank 15 is configured to temporarily store the four color inks and to supply the four color inks to the ink-jet head 3. The sub tank 15 includes a supply channel 15*a* which is formed in the sub tank 15, which is connected to the ink-jet head 3 and via which the inks are supplied to the ink-jet head 3. Note that FIG. 1 depicts only a part of the supply channel 15*a*. Further, the phrase that "the supply channel 15*a* is connected to the ink-jet head 3" means such a configuration or situation that the supply channel 15*a* is connected to a channel (flow channel) inside the ink-jet head 3 (channel unit 13), and that the ink can be supplied from the supply channel 15*a* to the channel inside the ink-jet head 3 (nozzles 10).

Furthermore, the supply channel 15*a* of the sub tank 15 is connected, via four tubes 31 respectively, to four ink cartridges 32 which are arranged side by side in the scanning direction at a right front end part of the printer 1. The four ink cartridges 32 are installed in a cartridge installing section 33 which is fixed to the cashing of the printer 1 such that the four ink cartridges 32 are removable from the cartridge installing section 33. The black, yellow, cyan and magenta inks are stored, respectively, in the four ink cartridges 32 in this order from a rightmost side ink cartridge 32 which is included in the four ink cartridges 32 and which is located at the right side in the scanning direction; the four color inks that are the black, yellow, cyan and magenta inks stored in the four ink cartridges 32, respectively, are supplied to the ink-jet head 3 via the four ink tubes 31 and the sub tank 15. Here, the inks stored in the ink cartridges 32 are each a pigment ink containing pigment particles.

The platen 4 is located at a position below the ink-jet head 3, and faces (is opposite to) the nozzle surface 13*a* during printing. The platen 4 extends in the scanning direction, over the entire length of a recording paper P (recording paper sheet P, or recording sheet P), and supports the recording paper P from therebelow. The conveyance rollers 5 and 6 are located respectively on the upstream side and the downstream side in the conveyance direction of the platen 4. The conveyance rollers 5 and 6 are connected to a conveyance motor 57 (see FIG. 2) via a non-illustrated gear, etc. In a case that the conveyance motor 57 is driven, the conveyance rollers 5 and 6 are thereby rotated to convey the recording paper P in the conveyance direction.

The flushing foam 7 is, for example, a sponge which is capable of absorbing the ink, and is located on the left side in the scanning direction with respect to the platen 4. Corresponding to this, in the printer 1, a controller 50 (to be described later on) performs control so as to move the carriage 2 to a flushing position at which the nozzle surface 13*a* is capable of facing (of being opposite to) the flushing foam 7. With this, it is possible to perform, in the printer 1, a pre-print flushing and a during-printing flushing (each to be described later on) in each of which the ink-jet head 3 is caused to jet the ink from the plurality of nozzles 10 in a state that the carriage 2 is located at the flushing position, thereby discharging any highly viscous ink inside the nozzles 10.

<Maintenance Unit>

The maintenance unit 8 includes a cap 21, a switching unit 22, a suction pump 23 and a waste liquid tank 24.

The cap 21 is located on the right side in the scanning direction with respect to the platen 4. Corresponding to this, it is possible, in the printer 1, to move the carriage 2 up to a maintenance position at which the nozzle surface 13*a* faces (is opposite to) the cap 21. The cap 21 has a cap section 21*a* and a cap section 21*b* located on the left side of the cap section 21*a*. In a state that the carriage 2 is located at the maintenance position, nozzles 10 included in the plurality of nozzles 10 and constructing the nozzle row 9 on the rightmost side face the cap section 21*a*, and nozzles 10 included in the plurality of nozzles 10 and constructing three nozzle rows 9 on the left side face the cap section 21*b*.

Further, the cap 21 is capable of being raised and lowered (ascended/descended, moving in the up/down direction) by a cap ascending/descending mechanism 58 (see FIG. 2; corresponding to a "switching mechanism" of the present teaching); in a case that the cap 21 is raised in a state that the carriage 2 is located at the maintenance position, the cap 21 makes tight contact with the nozzle surface 13*a* of the ink-jet head 3 so as to cover the plurality of nozzles 10 with the cap 21. More specifically, the nozzles 10 forming the nozzle row 9 on the rightmost side are covered by the cap section 21*a*, and the nozzles 10 forming the three nozzle rows 9 on the left side are covered by the cap section 21*b* (in the following, a state of the cap 21 in this situation is referred also to as a "capping state" in some cases). On the other hand, in a state that the cap 21 is lowered by the cap ascending/descending mechanism 58, the cap 21 is separate and away from the ink-jet head 3 (in the following, a state of the cap 21 in this situation is referred also to as an "uncapping state", in some cases). Namely, the cap ascending/descending mechanism 58 raises and lowers the cap 21 to thereby perform switching of the state of the cap 21 between the capping state and the uncapping state.

Further, the cap 21 is not limited to being configured to make tight contact with the nozzle surface 13*a* to cover the plurality of nozzles 10. For example, in a case that the channel unit 13 has a frame arranged so as to surround the nozzle surface 13*a* for the purpose of protecting the nozzles 10, the cap 21 may be configured to make tight contact with this frame to thereby cover the nozzles 10.

The switching unit 22 is connected to the cap sections 21*a* and 21*b* via tubes 29*a* and 29*b*, respectively. Further, the switching unit 22 is connected to the suction pump 23 via a tube 29*c*. The switching unit 22 performs switching between the connection of the suction pump 23 with the cap section 21*a* and the connection of the suction pump 23 with the cap section 21*b*. The suction pump 23 is, for example, a tube pump, etc. Further, the suction pump 23 is connected to the waste liquid tank 24.

Further, in the printer 1, in a state that the cap 21 is in the capping state, the controller 50 performs a control such that the switching unit 22 is caused to connect the cap section 21*a* to the suction pump 23 and that the suction pump 23 is driven, thereby making it possible to perform a suction purge regarding the black ink for causing the black ink in the channel unit 13 to be discharged from the nozzles 10 forming the nozzle row 9 on the rightmost side. Similarly, in the printer 1, in the state that the cap 21 is in the capping state, the controller 50 performs a control such that the switching unit 22 is caused to connect the cap section 21*b* to the suction pump 23 and that the suction pump 23 is driven, thereby making it possible to perform a suction purge regarding the color inks (yellow, cyan and magenta inks) for causing the yellow, cyan and magenta inks in the channel unit 13 to be discharged from the nozzles 10 forming the three nozzle rows 9 on the left side. Furthermore, after performing the suction purge regarding the black ink and the suction purge regarding the color inks, the cap 21 is lowered to thereby separate the cap 21 away from the nozzle surface 13*a* and to make the cap 21 to be in the uncapping state and then the suction pump 23 is driven, thereby making it possible to execute an empty suction for causing any ink, remaining in the cap 21 due to the suction purge, to be discharged from the cap 21. Note that even though the ink remained in the cap 21 is discharged by the empty suction, the ink remains inside the cap 21 more or less (to some extent). Moreover, the ink discharged by the suction purge and the empty suction is stored in the waste liquid tank 24.

Further, in the printer 1, it is possible to perform a moisture-retention flushing operation (to be described later on) for causing the ink-jet head 3 to jet the ink from the plurality of nozzles 10 in a state that the carriage 2 is located at the maintenance position, thereby discharging the ink inside the nozzles 10 to the cap 21.

<Electrical Configuration of Printer>

Figure 2:
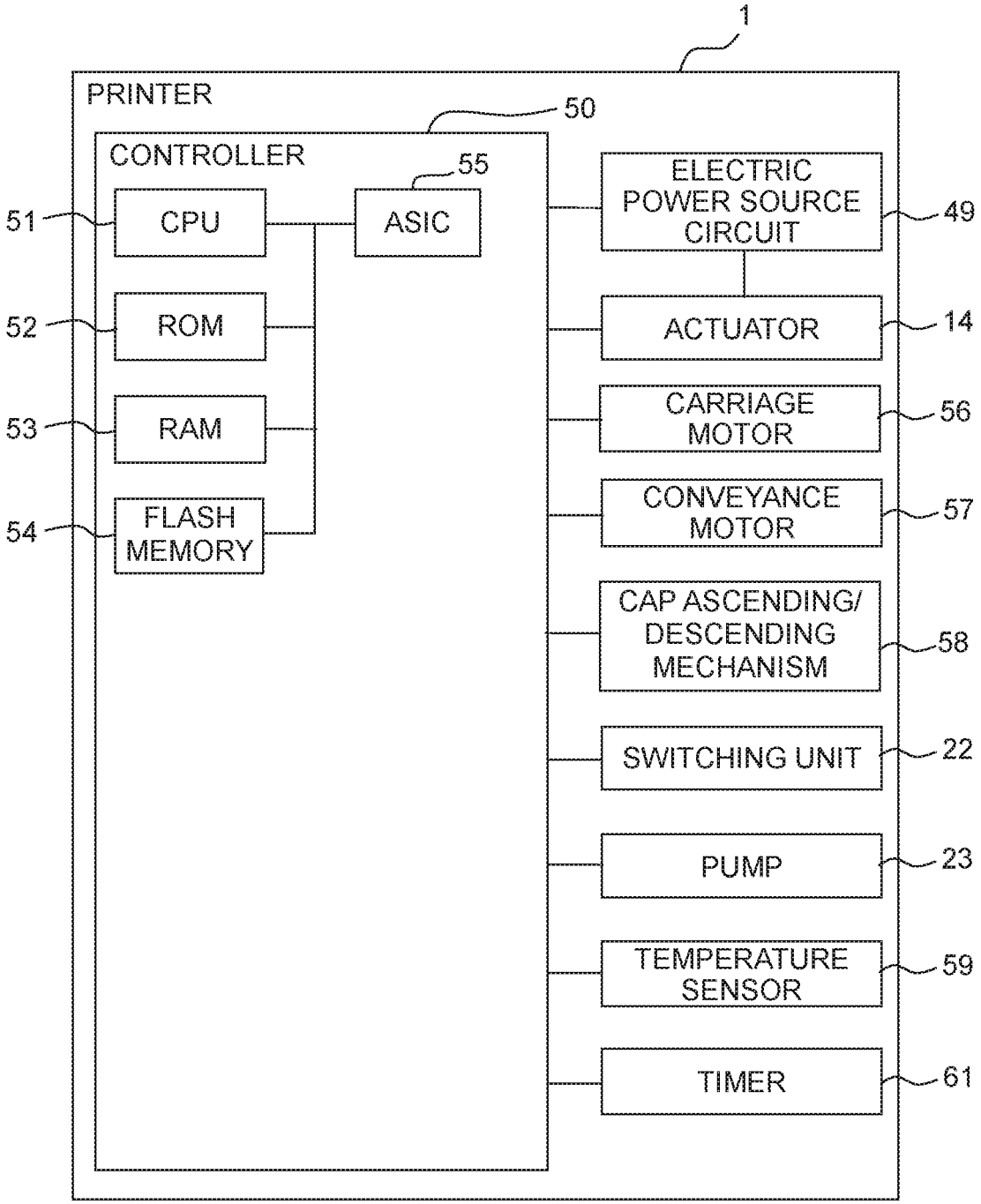
FIG. 2 is a block diagram depicting the electrical configuration of the printer according to the embodiment of the present teaching.

Next, an explanation will be given about the electrical configuration of the printer 1. The operation of the printer 1 is controlled by the controller 50. As depicted in FIG. 2, the controller 50 includes a CPU (Central Processing Unit) 51, a ROM (Read Only Memory) 52, a RAM (Random Access Memory) 53, a flash memory 54, an ASIC (Application Specific Integrated Circuit) 55, etc., and these components or elements control the carriage motor 56, the actuator 14, the electric power source circuit 49, the conveyance motor 57, the cap ascending/descending mechanism 58, the switching unit 22, the suction pump 23, etc. The printer 1 further has a temperature sensor 59 configured to obtain temperature information regarding the temperature around the printer 1, and the temperature information obtained by the temperature sensor 59 is inputted to the controller 50. Further, the printer 1 has a timer 61 configured to perform measurement of time.

Note that although FIG. 2 depicts only one CPU 51, it is allowable that the controller 50 is provided with only one piece of the CPU 51 and that the only one CPU 51 singly performs the processings. Alternatively, it is allowable that the controller 50 is provided with a plurality of pieces of the CPU 51 and that these CPUs 51 perform the processings in a sharing manner. Further, note that although FIG. 2 depicts only one ASIC 55, it is allowable that the controller 50 is provided with only one piece of the ASIC 55 and the only one ASIC 55 singly performs the processings. Alternatively, it is allowable that the controller 50 is provided with a plurality of pieces of the ASICS 55 and that these ASICs 55 execute the processings in a shared manner.

Here, in the printer 1, the controller 50 calculates a supply evaporation rate Dp (to be described later on), a cap evaporation rate Dc which is an evaporation rate of the water content in the ink inside the cap 21, and a viscosity Ws in the ink inside the sub tank 15, for the purpose of using the supply evaporation rate Dp, the cap evaporation rate Dc and the viscosity Ws in the control during printing. Here, the supply evaporation rate Dp is an evaporation rate of a water content of the ink in a process until the ink enters into the inside of the supply channel 15*a* of the sub tank 15. The supply evaporation rate Dp is obtained based on an evaporation rate of the water content in the ink in a flow channel (for example, the tube 31) from the ink cartridge 32 and until arrival (up to) the supply channel 15*a* of the sub tank 15, and based on an evaporation rate of the water content in the ink inside the ink cartridge 32. Note that it is considered that the water content of the ink hardly evaporates inside the supply channel 15*a* of the sub tank 15 In the following, methods for performing these calculations will be explained. Note that although the term "supply evaporation rate Dp" is used for the sake of convenience, the "Dp" is not limited only to being the supply evaporation rate itself, and may be another parameter relating to the supply evaporation rate. This is applicable similarly also to the cap evaporation rate Dc, the viscosity Ws and a nozzle evaporation rate Dn (to be described later on).

<Calculation of Supply Evaporation Rate>

Figures 3A, 3B:
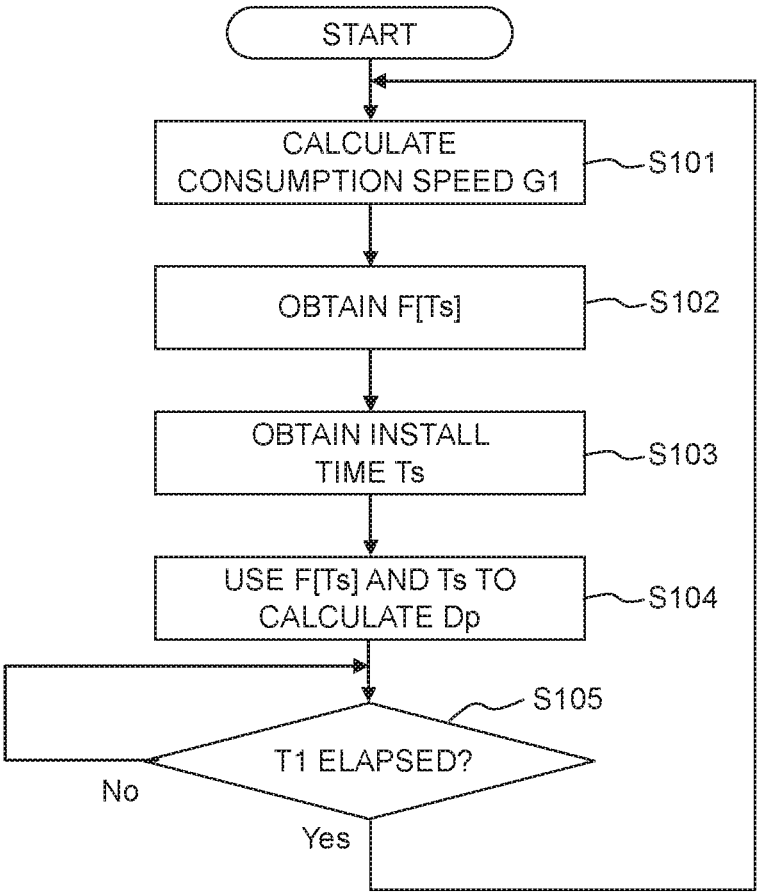
FIG. 3A is a flowchart depicting the flow of a processing for obtaining a supply evaporation rate.
FIG. 3B is a view indicating a table in which the temperature and a consumption amount of an ink per average unit time are associated with the supply evaporation rate.

Next, the method for calculating the supply evaporation rate Dp will be explained. The controller 50 obtains a value of the supply evaporation rate Dp by performing control along the flow in FIG. 3A. The flow of FIG. 3A is started at a time when the receptacle of the printer is connected to a power supply source for the first time. To provide more detailed explanation regarding the flow of FIG. 3A, the controller 50 firstly calculates a consumption speed G1 which is a consumption amount of the ink per unit time in the ink-jet head 3 (S101). The controller 50 counts a jetting count (number of time of jetting) and a suction purge count (number of times of suction purge) and causes the flash memory 54 to store the jetting count and the suction purge count therein. In S101, the controller 50 calculates the consumption speed G1 from the jetting count of the ink and the suction purge count which have been counted by the controller 50.

Next, the controller 50 obtains a function F[Ts] for calculating the supply evaporation rate Dp (S102). The supply function F[Ts] is a function of an install time Ts that is a time (elapsed) since the ink cartridge 32 has been installed in the cartridge installing section 33, and is such a function that the value thereof becomes greater as the install time Ts becomes longer.

The flash memory 54 stores a table in which a temperature U indicated by the temperature information obtained by the temperature sensor 59 and the consumption speed G1 are associated with the function F[Ts], for example as depicted in FIG. 3B. In S102, the controller 50 obtains the function F[Ts] based on the temperature U and the consumption speed G1 calculated in S101 and based on the table of FIG. 3B.

Provided that the install time Ts is same, functions F11[Ts], F12[Ts], F13[Ts], F21[Ts], F22[Ts], F23[Ts], F31[Ts], F32[Ts] and F33[Ts] have a magnitude relationship of: F11[Ts]>F12[Ts]>F13[Ts], F21[Ts]>F22[Ts]>F23[Ts], and F31[Ts]>F32[Ts]>F33[Ts]; and have a magnitude relationship of F11[Ts]<F21[Ts]<F31[Ts], F12[Ts]<F22[Ts]<F32[Ts], and F13[Ts]<F23[Ts]<F33[Ts]. Namely, as the consumption speed G1 is greater, the value of the function F[Ts] becomes smaller; as the temperature is greater, the value of the function F[Ts] becomes greater.

Next, the controller 50 obtains the install time Ts based on a result of measurement performed by the timer 61 (S103). Next, the controller 50 uses the function F[Ts] obtained in S101 and the install time Ts obtained in S202 so as to calculate the supply evaporation rate Dp (S104).

Here, as the consumption speed G1 is greater, the amount of the ink which is newly supplied per unit time from the ink cartridge 32 to the sub tank 15 becomes greater. Further, as the temperature U is higher, the evaporation of the water content in the ink is more easily advanced. Furthermore, the ink cartridge 32 is normally provided with an atmosphere communication channel (passage) which is formed therein and which is configured to allow the air to flow into the ink cartridge 32 in an amount corresponding to the amount of the ink flowed out from the ink cartridge 32; and the water content in the ink inside the ink cartridge 32 is evaporated to the outside of the ink cartridge 32 via the atmosphere communication channel. Further, as the install time Ts is longer, the evaporation of the water content in the ink inside the ink cartridge 32 to the outside thereof is more advanced.

In view of the above-described situation, the supply evaporation rate Dp obtained as described above is the supply evaporation rate according to the evaporation rate of the water content in the ink inside the supply channel 15*a* of the sub tank 15 and the supply evaporation rate according to the evaporation rate of the water content in the ink inside the ink cartridge 32. Here, the term "evaporation rate of the water content in the ink inside the supply channel 15*a*" means an evaporation rate of the water content with a time, at which the ink is supplied to the supply channel 15*a*, as the reference. Further, the term "evaporation rate of the water content in the ink inside the ink cartridge 32" means an evaporation rate of the water content with a time, at which the ink cartridge 32 is installed in the cartridge installing section 33, as the reference.

Afterwards, the controller 50 stands by until a predetermined time T1 elapses (S105: NO); under a condition that the predetermined time T1 has elapsed (S105: YES), the controller 50 returns the processing to S101. Namely, the controller 50 performs the processings of S101 to S104 every time the predetermined time T1 elapses, and updates the supply evaporation rate Dp. Note that the method of calculating the supply evaporation rate Dp is not limited to or restricted by the above-described method; it is allowable that the supply evaporation rate Dp is calculated by another method different from the above-described method. Alternatively, instead of calculating the supply evaporation rate Dp, it is allowable to provide a configuration for directly measuring the viscosity of the ink inside the ink-jet head 3 and/or in the sub tank 15, and to use the result of this measurement so as to obtain the supply evaporation rate Dp.

<Calculation of Cap Evaporation Rate>

Figure 4:
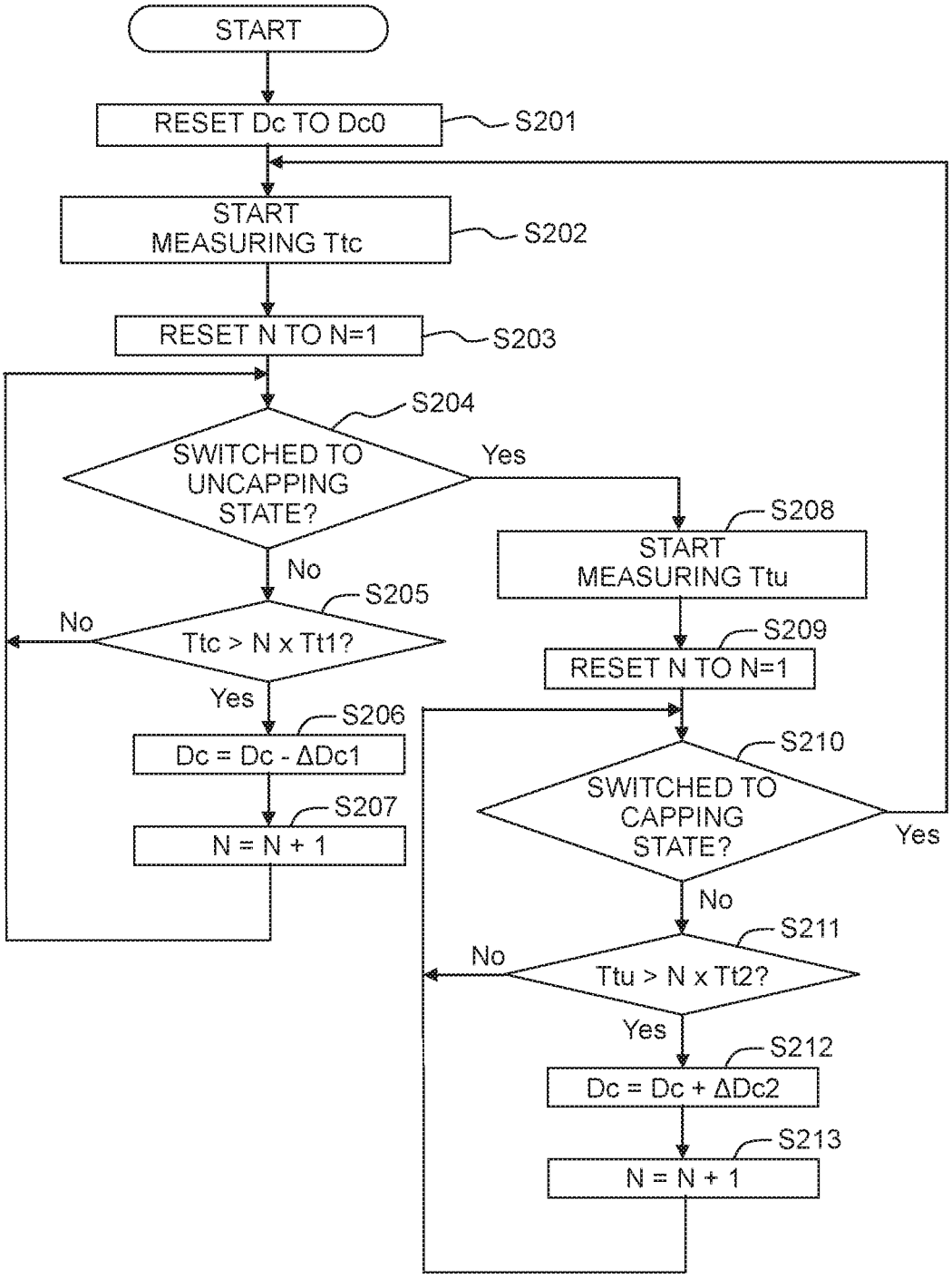
FIG. 4 is a flowchart depicting the flow of a processing for calculating a cap evaporation rate.

Next, the method for calculating the cap evaporation rate Dc will be explained. The controller 50 obtains a value of the cap evaporation rate Dc by performing control along the flow in FIG. 4. The flow of FIG. 4 is started at a time when the receptacle of the printer is connected to a power supply source for the first time. Here, in the printer 1 in a before-use state, the cap 21 is in the capping state. In a case that the receptacle of the printer 1 is connected to the power supply source for the first time, the suction purge for the black and the suction purge for the color inks, and the empty suction are performed, and then the state of the cap 21 is returned to the capping state.

The controller 50 firstly resets the cap evaporation rate Dc to an initial value Dc0, and causes the RAM 50 to store the reset cap evaporation rate Dc (S201). The initial value Dc0 is a value not less than the supply evaporation rate Dp. Next, the controller 50 starts measuring a duration time Ttc of the capping state (hereinafter referred also to as a "capping duration time Ttc" in some cases) with the timer 61 (S202), and resets a value of a variable N to "1 (one)" (S203).

Under a condition that the state of the cap 21 is not switched to the uncapping state (S204: NO) and that the capping duration time Ttc does not exceed a time [N×Tt1] that is N times a predetermined time Tt1 (S205: NO), the controller 50 returns the processing to S204. On the other hand, under a condition that the capping duration time Ttc exceeds the time [N×Tt1] (S205: YES), the controller 50 updates the cap evaporation rate Dc stored in the RAM 53 to a value [Dc−ΔDc1] which is obtained by reducing the cap evaporation rate Dc stored in the RAM 53 by ΔDc1 (S206), increase the value of the variable N by 1 (one) (S207), and returns the processing to S204. With this, the cap evaporation rate Dc is made to be smaller by ΔDc1 every time the capping duration time Ttc elapses by the time Tt1.

Under a condition that the state of the cap 21 is switched to the uncapping state (S204: YES), the controller 50 starts measuring a duration time Ttu of the uncapping state (hereinafter referred also to as an "uncapping duration time Ttu" in some cases) with the timer 61 (S208), and rests the value of the variable N to 1 (one).

Then, under a condition that the state of the cap 21 is not switched to the capping state (S210: NO) and that the uncapping duration time Ttu does not exceed a time [N×Tt2] that is N times a predetermined time Tt2 (S211: NO), the controller 50 returns the processing to S210. On the other hand, under a condition that the uncapping duration time Ttu exceeds the time [N×Tt2] (S211: YES), the controller 50 updates the cap evaporation rate Dc stored in the RAM 53 to a value [Dc+ΔDc2] which is obtained by increasing the cap evaporation rate Dc stored in the RAM 53 by ΔDc2 (S212), increase the value of the variable N by 1 (one) (S213), and returns the processing to S210. With this, the cap evaporation rate Dc is made to be greater by ΔDc2 every time the uncapping duration time Ttu elapses by the time Tt2. Here, the time Tt2 may be same as the time Tt1, or may be different from the time Tt1. Further, the value ΔC2 may be same as ΔC1, or may be different from ΔC1. Further, under condition that the state of the cap 21 is switched to the capping state (S210: YES), the controller 50 returns the processing to S202.

Here, in a case that the cap 21 is in the uncapping state, the water content in the ink inside the cap 21 evaporates to the outside of the cap 21, thereby increasing the cap evaporation rate Dc. On the other hand, normally, an ink contains a humectant for suppressing the evaporation of the water content. Accordingly, in a case that the cap 21 is in the capping state, the humectant in the ink inside the cap 21 absorbs the water content, thereby causing the water content to move from the ink inside the nozzles 10 to the ink inside the cap 21. Due to this movement of the water content, the cap evaporation rate Dc is lowered. From those as described above, it is appreciated that the cap evaporation rate Dc becomes smaller as the capping duration time Ttc is longer, and becomes greater as the uncapping duration time Ttu is longer. Accordingly, the cap evaporation rate Dc which is calculated as described above is made to be close to an actual cap evaporation rate. Note that the method for calculating the cap evaporation rate Dc is not limited to the method described above; the cap evaporation rate Dc may be calculated by another method.

<Calculation of Viscosity of Ink Inside Sub Tank>

Figure 5A:
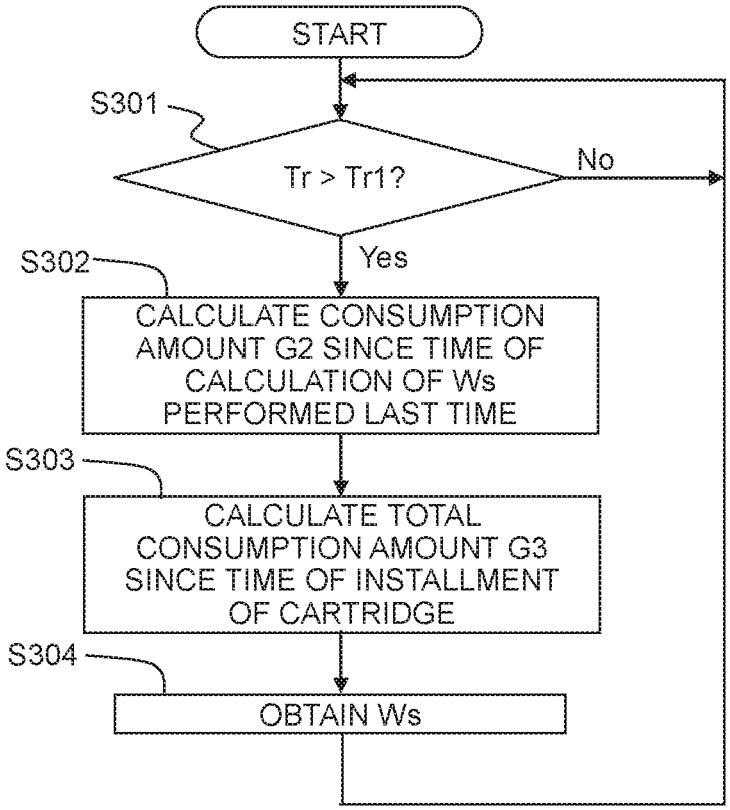
FIG. 5A is a flowchart depicting the flow of a processing for obtaining the viscosity of the ink inside a nozzle.

Next, an explanation will be given about the calculation of the viscosity Ws of the ink inside the sub tank 15. As depicted in FIG. 5A, the controller 50 stands by until an elapsed time Tr, elapsed since a time of the calculation of the viscosity Ws performed last time, exceeds a predetermined time Tr1 (for example, one month) (S301: NO). Then, under a condition that the elapsed time Tr exceeds the predetermined time Tr1 (S301: YES), the controller 50 calculates a consumption amount G2 of the ink in the ink-jet head 3 since the time of the calculation of the viscosity Ws performed last time, and a total consumption amount G3 of the ink in the ink cartridge 3 since a time of installment of the ink cartridge 3 in the cartridge installing section 33 (S302, S303). As described above, the controller 50 counts the jetting count of the ink from the nozzles 10 and the suction purge count and causes the flash memory 54 to store the jetting count of the ink from the nozzles 10 and the suction purge count. In S302 and S303, the controller 50 calculates the consumption amount G2 and the total consumption amount G3 based on the jetting count and the suction purge count.

Next, the controller 50 obtains the viscosity Ws based on the consumption amount G2 and the total consumption amount G3 calculated in S302 and S303, respectively (S304) and the controller 50 returns the processing to S301.

Here, in the pigment ink inside the ink cartridge 32, the pigment particles in the ink sediment over time. Accordingly, the viscosity Ws of the pigment ink inside the sub tank 15 and supplied from the ink cartridge 32 is gradually increased, influenced by the sedimentation of the pigment particles, as the consumption of the ink is progressed since the time of the installment of the ink cartridge 32. Further, after an ink in which the pigment particles sediment and which is highly viscous is supplied to the sub tank 15, a top layer (top portion) of the ink inside the ink cartridge 32, which is located above another layer (another portion) of the ink with the sedimented pigment particles therein and in which the concentration of the pigment particles is small (the viscosity is small) than the another layer, is supplied from the ink cartridge 32 to the sub tank 15. Accordingly, in a case that the ink is further consumed, the viscosity Ws of the ink inside the sub tank 15 is lowered. Further, in this situation, as the consumption amount G2 is smaller, the sedimentation of the pigment particles in the ink inside the ink cartridge 32 advances more easily, which in turn causes an amount of the change in the viscosity Ws due to the advancement of the ink consumption becomes great.

Figure 5B:
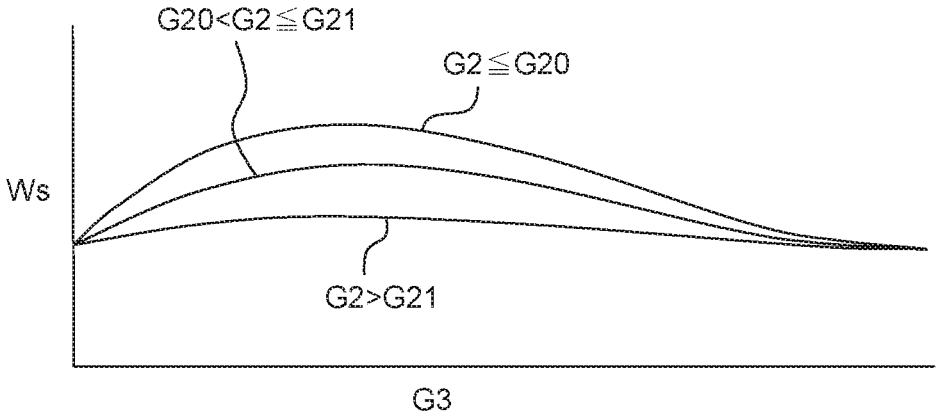
FIG. 5B is a view indicating relationship between a cartridge consumption amount per a consumption amount of the ink per a predetermined time, and the viscosity of the ink inside the nozzle.

It is appreciated, from those as described above, that the total consumption amount G3 and the viscosity Ws are, every time the ink is consumed by the consumption amount G2, in a relationship as depicted in FIG. 5B. FIG. 5B depicts the relationship between the total consumption amount G3 and the viscosity Ws in the following three cases wherein the consumption amount G2 is: (i) G2>G21; (ii) G20<G2≤G21; and (iii) G2≤G20. In any one of these cases, as described above, as the total consumption amount G3 of the ink becomes greater, the viscosity Ws of the ink becomes greater, whereas the total consumption amount G3 of the ink becomes further greater, the viscosity Ws of the ink is lowered. Further, as appreciated from the comparison among the above-described cases (i) to (iii), as the consumption amount G2 is smaller, the amount of the change in the viscosity Ws, due to the increase in the total consumption amount G3 of the ink (as the total consumption amount G3 becomes to be greater), becomes to be greater. The flash memory 54 stores therein, for example, a table in which the consumption amount G2 and the total consumption amount G3 are associated with the viscosity Ws, corresponding to the relationship of FIG. 5B. Then, in S304, the controller 50 obtains the viscosity Ws from the consumption amount G2 and the total consumption amount G3 and from the table corresponding to the relationship of FIG. 5B. With this, the obtained viscosity Ws is made to be close to an actual viscosity of the ink inside the sub tank 15.

<Control During Printing>

Next, an explanation will be given about the control performed by the controller 50 in a case that a print instruction for causing the printer 1 to perform printing is inputted. In a case that the print instruction is inputted to the printer 1, the controller 50 performs a processing along the flow as depicted in FIGS. 6A and 6B.

Figure 6A:
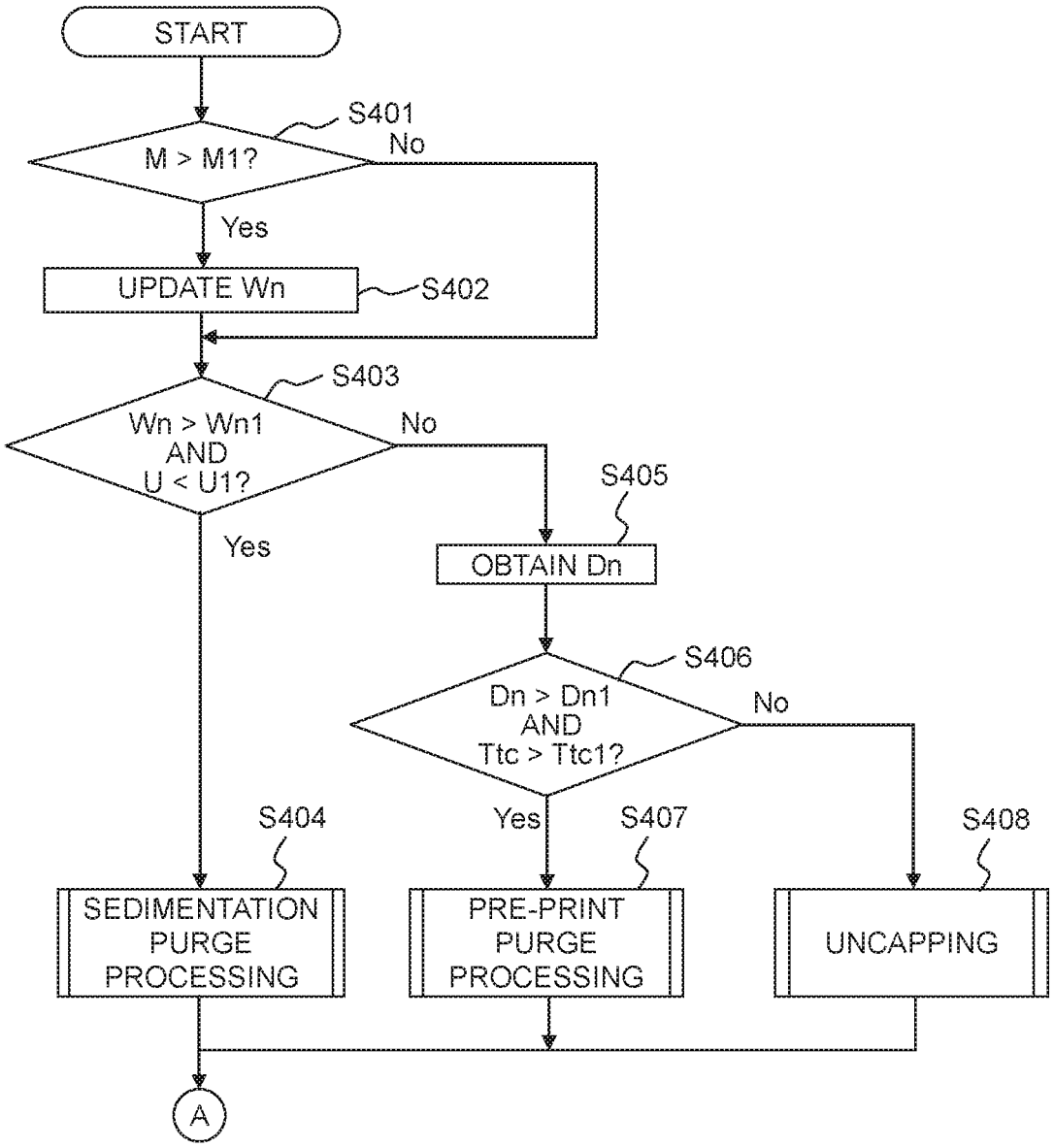
FIGS. 6A and 6B are flowcharts depicting the flow of a processing during printing.
Figure 6B:
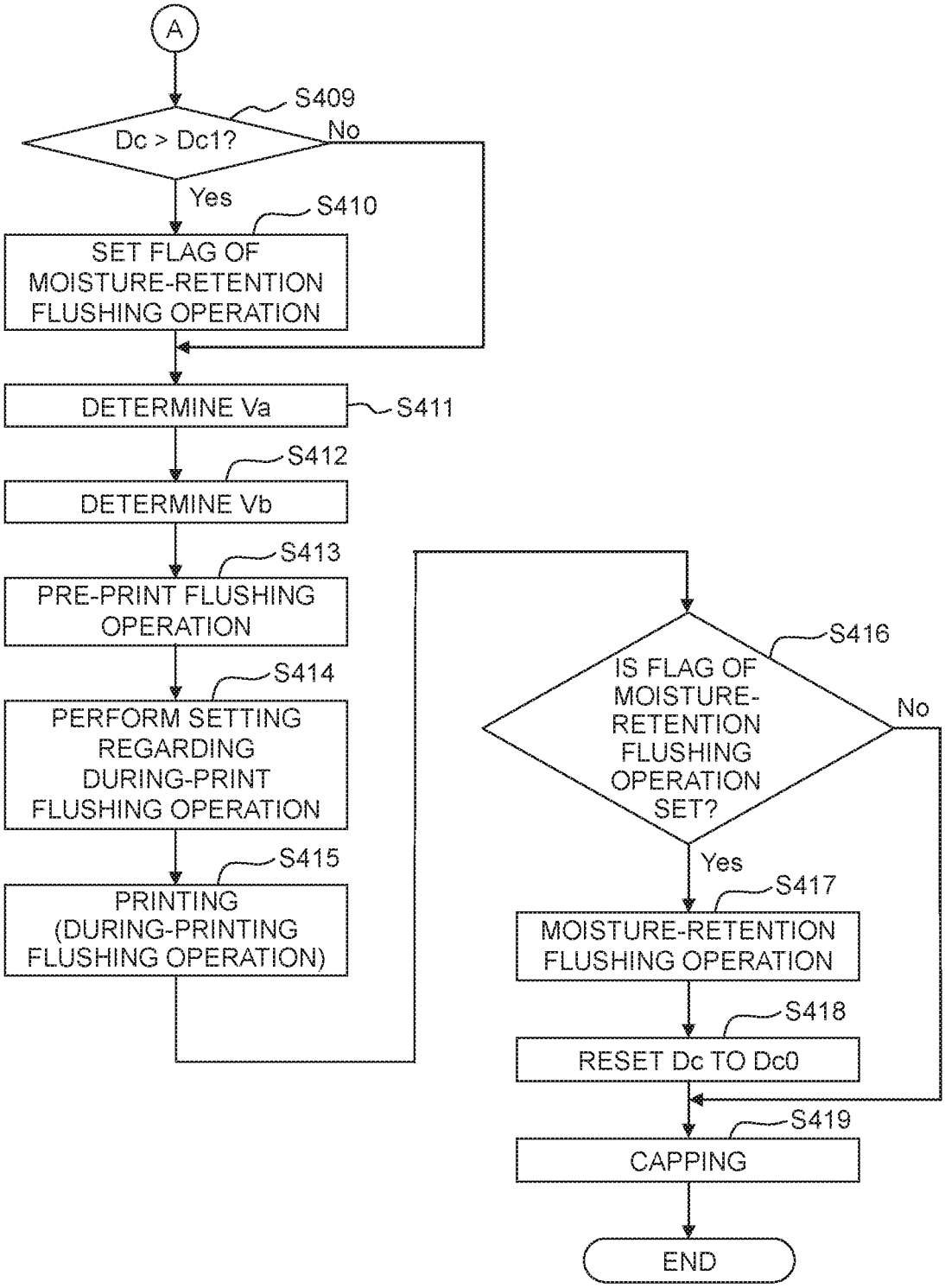

To provide a more specific explanation, as depicted in FIGS. 6A and 6B, in a case that the print instruction is inputted, the controller 50 firstly determines whether or not a jetting count M of the ink jetted from the nozzles 10, since a time of obtainment of the viscosity Wn of the ink inside the ink-jet head 3 performed last time, exceeds a predetermined count M1 (S401). As described above, the jetting count M is obtained from the jetting count of the ink from the nozzles 10 counted by the controller 50. In a case that the jetting count M exceeds the predetermined count M1 (S401: YES), the controller 50 calculates the viscosity Wn of the ink inside the ink-jet head 3 based on the calculated viscosity Ws of the ink inside the sub tank 15 and the supply evaporation rate Dp, and updates the value of the viscosity Wn stored in the RAM 53 (S402). In this situation, the viscosity Wn is calculated such that the viscosity Wn is made higher as the viscosity Ws is higher, and that the viscosity Wn is made higher as the supply evaporation rate Dp is higher. Note that at a time when the printer 1 is used for the first time, the viscosity Wn is set to a predetermined initial value, and is stored in the RAM 53. On the other hand, in a case that the jetting count M of the ink from the nozzles 10 since a time of calculation of the viscosity Wn performed last time is not more than the predetermined time M1 (S401: NO), the controller 50 proceeds the processing to S403, without updating the value of the viscosity Wn.

In S403, the controller 50 determines whether or not a sedimentation purge condition that the viscosity Wn exceeds a threshold value Wn1 and that the temperature U indicated by the temperature information obtained by the temperature sensor 59 is lower than a temperature U1 is satisfied (determines whether or not a sedimentation purge operation, which will be described later on, is to be performed) (S403). In a case that the sedimentation purge condition is satisfied (S403: YES), the controller 50 next executes a sedimentation purge processing (S404).

Figure 7A:
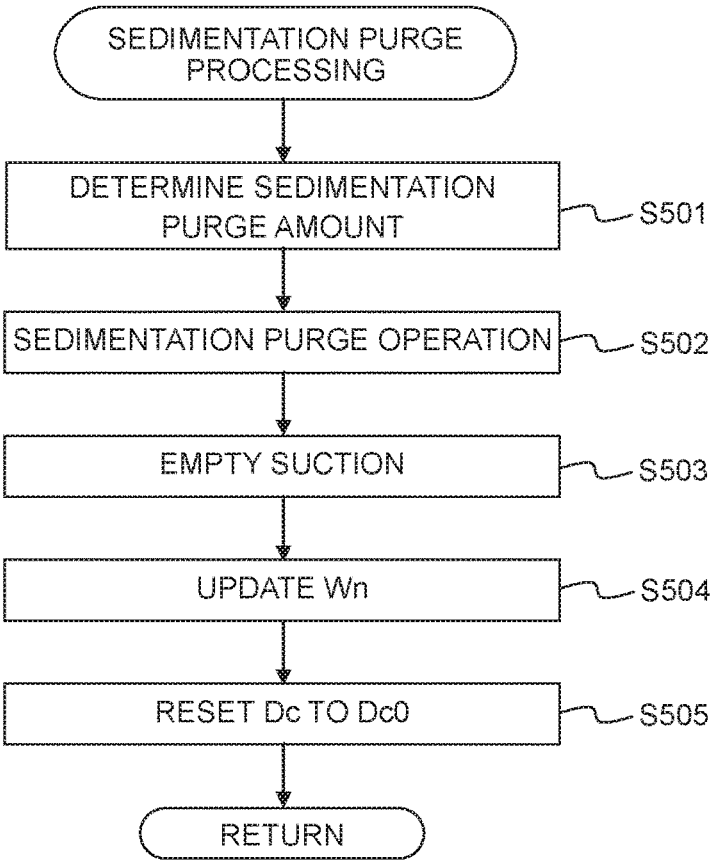
FIG. 7A is a flowchart depicting the flow of a sedimentation purge processing of FIG. 6A.

In the sedimentation purge processing, the controller 50 firstly determines a sedimentation purge amount Ea which is a discharge amount of the ink in the sedimentation purge operation which is to be performed next (S501), as indicated in FIG. 7A. The flash memory 54 stores a table wherein purge amounts E0 to E5 (E0<E1<E2<E3<E4<E5) which are discharge amounts of the ink by the suction purge and a reduction amount ΔWn of the viscosity Wn due to the suction purge are associated with one another, as depicted in FIG. 8A. In S501, the smallest purge amount, in purge amounts which are included in the purge amounts E1 to E5 of FIG. 8A, and by which a viscosity [Wn−ΔWn] of the ink inside the ink-jet head 3 after the sedimentation purge operation (suction purge) becomes to be not more than a predetermined viscosity Wn2, is determined as the sedimentation purge amount Ea. Here, in S501, the sedimentation purge amount is determined with respect to each of the suction purge regarding the black ink and the suction purge regarding the color inks. However, the manner by which the sedimentation purge amount is determined is similar among the respective suction purges, the explanation thereabout will be given in a collective manner, for the sake of convenience. Note that the purge amount E0 in FIG. 8A is used as a purge amount of a pre-print purge operation (to be described later on).

Next, the controller 50 controls the cap ascending/descending mechanism 58, the switching unit 22 and the suction pump 23 so as to perform the sedimentation purge operation (S502). In the sedimentation purge operation, the suction purge regarding the black ink and the suction purge regarding the color inks are performed sequentially. In this situation, the driving time of the suction pump 23 is made longer as the calculated sedimentation purge amount Ea is greater, thereby discharging the ink from the nozzles 10 in the sedimentation purge amount Ea. With this, in a case that the viscosity of the ink inside the ink-jet head 3 is (has becomes to be) high due to the sedimentation of the pigment particles, it is possible to discharge the ink, which is inside the ink-jet head 3 and in which the pigment particles are sediment, by performing the sedimentation purge operation.

Further, in a case that the viscosity of the ink inside the ink-jet head 3 is high and that the rotation speed of the suction pump 23 in the suction purge is made to be high, there is such a fear that the ink might not be able to flow easily, and that the ink might not be discharged in a desired amount. In view of this situation, for example, in a case that the sedimentation purge amount Ea is greater than a predetermined amount (in a case that the degree or extent of the increase in the viscosity in the ink inside the ink-jet head 3 is great), the rotation speed of the suction pump 23 in the suction purge is made to be slow.

Then, after the sedimentation purge operation, the controller 50 performs the empty suction (S503), updates the viscosity Wn stored in the RAM 53 to the viscosity [Wn−ΔWn] after the sedimentation purge operation (S504), and resets the cap evaporation rate Dc to the initial value D0 (S505), thereby completing the sedimentation purge processing. Here, when performing the empty suction in S503, the state of the cap 21 is switched to the uncapping state. Then, after the sedimentation purge processing, the controller 50 proceeds the processing to S409.

On the other hand, in a case that the sedimentation purge condition is not satisfied (S403: NO), the controller 50 then obtains an evaporation rate Dn of the water content in the ink inside the nozzles 10 (hereinafter referred also to as a "nozzle evaporation rate Dn" in some cases) (S405). The flash memory 54 stores therein a table in which the supply evaporation rate Dp and the cap evaporation rate Dc are associated with the nozzle evaporation rate Dn, for example as depicted in FIG. 8B; the controller 50 obtains the nozzle evaporation rate Dn based on a current supply evaporation rate Dp and a current cap evaporation rate Dc, and based on the table of FIG. 8B. Alternatively, it is also allowable that the flash memory 54 stores a relational expression for calculating the nozzle evaporation rate Dn from the supply evaporation rate Dp and the cap evaporation rate Dc, and that the nozzle evaporation rate Dn is calculated by using the supply evaporation rate Dp and the cap evaporation rate Dc, and by using this relational expression.

Next, the controller 50 determines whether or not a pre-print purge condition that the nozzle evaporation rate Dn exceeds a threshold value Dn1 and that the capping duration time Ttc measured by the timer 61 exceeds a predetermined time Ttc1 (S406). In a case that the pre-print purge condition is satisfied (S406: YES), the controller 50 then performs a pre-print purge processing (S407).

Figure 7B:
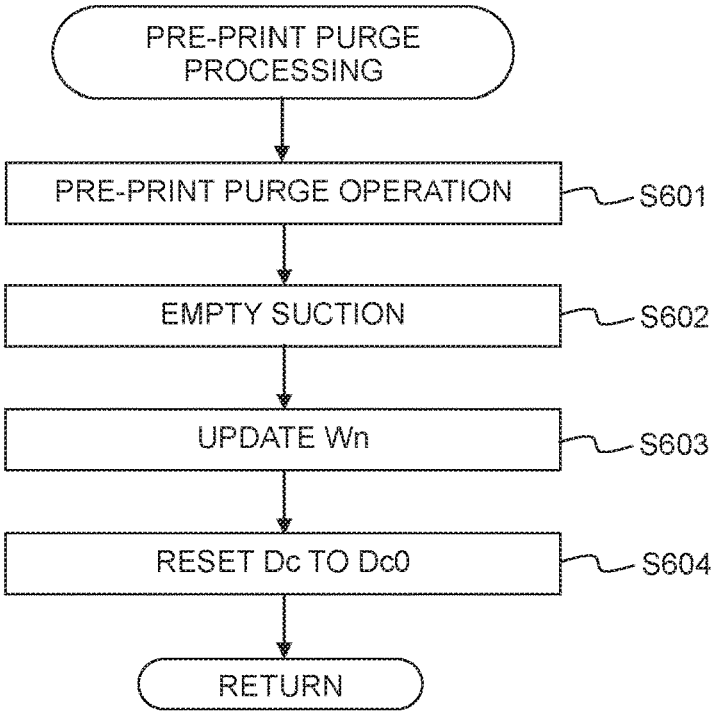
FIG. 7B is a flowchart depicting the flow of a pre-print purge processing of FIG. 6A.

In the pre-print purge processing, as depicted in FIG. 7B, the controller 50 firstly controls the cap ascending/descending mechanism 58, the switching unit 22 and the suction pump 23 to perform a pre-print purge operation (corresponding to a "pre-jetting purge operation" of the present teaching) (S601). In the pre-print purge operation, the suction purge regarding the black ink and the suction purge regarding the color inks are performed sequentially. Further, in the pre-print purge operation, a purge amount in each of respective suction purges is made to be a purge amount E0 which is smaller than the sedimentation purge amount Ea (any one of sedimentation purge amounts E1 to E5) as depicted in FIG. 8A. Here, in the pre-print pure operation, the purge amount is determined with respect to each of the suction purge regarding the black ink and the suction purge regarding the color inks. However, the manner by which the purge amount is determined is similar among the respective suction purges, the explanation thereabout will be given in a collective manner, for the sake of convenience.

Then, after completion of the pre-print purge operation, the controller 50 performs the empty suction (S602), updates the viscosity Wn stored in the RAM 53 to a viscosity [Wn−ΔWn0] after the pre-print purge operation (S603), and resets the cap evaporation rate Dc to the initial value D0 (S604), thereby completing the pre-print purge operation. Then, after the completion of the pre-print purge processing, the controller 50 proceeds the processing to S409. Here, when performing the empty suction in S602, the state of the cap 21 is switched to the uncapping state.

On the other hand, in a case that the pre-print purge condition is not satisfied (S406: NO), the controller 50 controls the cap ascending/descending mechanism 58 so as to switch the state of the cap 21 to the uncapping state (S408), and the controller 50 proceeds the processing to S409.

In S409, the controller 50 determines whether or not a moisture-retention flushing condition that a current cap evaporation rate Dc exceeds a threshold value Dc1. In a case that the moisture-retention flushing condition is satisfied (S409: YES), the controller 50 sets a flag of the moisture-retention flushing operation (which is to be described later on) (the controller 50 determines that the moisture-retention flushing operation is to be performed) (S410), and the controller 50 proceeds the processing to S411. On the other hand, in a case that the moisture-retention flushing condition is not satisfied (S409: NO), the controller 50 proceeds the processing to S411, without setting the flag.

In S411, the controller 50 determines a driving voltage Va which the controller 50 causes the electric power source circuit 49 to generate during printing. The flash memory 54 stores therein a table in which the temperature U and the viscosity Wn are associated with the driving voltage Va, for example as depicted in FIG. 8C. In S411, the controller 50 determines the driving voltage Va based on the temperature U and the viscosity Wn and based on the table of FIG. 8C. Here, driving voltages V1 to V3 of FIG. 8C have a magnitude relationship of: V1<V2<V3. Namely, as the viscosity Wn becomes higher and the temperature becomes lower, the driving voltage Va tends to be higher. During printing, as the viscosity Wn is higher and the temperature U is lower, the viscosity of the ink inside the ink-jet head 3 becomes higher. Accordingly, the driving voltage Va needs to be high for the purpose of jetting the ink from the nozzles 10 in a same jetting amount. In view of the above-described situation, the present embodiment sets the driving voltages V1 to V3 with respect to the viscosity Wn and the temperature U, as depicted in FIG. 8C. Note that in the present embodiment, for example, the driving voltage V1 which is the lowest among the driving voltages V1 to V3 corresponds to a "first driving voltage" of the present teaching, and the driving voltages V2 and V3 each of which is higher than the driving voltage V1 corresponds to a "second driving voltage" of the present teaching.

Next, the controller 50 determines a driving voltage Vb which the controller 50 causes the electric power source circuit 49 to generate during a pre-print flushing operation which is to be performed next (S412). The flash memory 54 stores therein a table in which the temperature U and the nozzle evaporation rate Dn are associated with the driving voltage Vb, for example as depicted in FIG. 8D. In S418, the controller 50 determines the driving voltage Vb based on the temperature U and the nozzle evaporation rate Dn and based on the table of FIG. 8D. During the pre-print flushing operation, as the nozzle evaporation rate Dn is higher and the temperature U is lower, the viscosity of the ink inside the nozzles 10 becomes higher. Accordingly, the driving voltage Vb needs to be high for the purpose of jetting the ink from the nozzles 10 in a same jetting amount. In view of the above-described situation, the present embodiment sets the driving voltages V1 to V3 with respect to the nozzle evaporation rate Dn and the temperature U, as depicted in FIG. 8D.

Next, the controller 50 controls the carriage motor 56 so as to move the carriage 2 to the flushing position, then controls the actuator 14 to thereby perform the pre-print flushing operation for causing the ink(s) to be jetted from the nozzles 10 toward the flushing foam 7 (S413). Further, during the pre-print flushing operation, the controller 50 causes the electric power source circuit 49 to generate the driving voltage Vb determined in S412. With this, any ink which is located inside the nozzles 10 and of which viscosity is increased is discharged.

Next, the controller 50 performs setting regarding a during-print flushing operation (corresponds to a during-jetting flushing operation" of the present teaching) (S414). In S414, for example, the controller 50 sets the frequency at which the during-print flushing operation is to be performed. The during-print flushing operation and the frequency thereof will be explained later on.

Next, the controller 50 controls the carriage motor 56, the actuator 14, the electric power source circuit 49 and the conveyance motor 57 to thereby perform printing (corresponding to a "jetting operation" of the present teaching) (S415). Specifically, the controller 50 controls the conveyance motor 57 so as to repeatedly perform a conveying operation for conveying the recording paper P by a predetermined distance; every time the controller performs the conveying operation, the controller 50 performs a pass operation by controlling the carriage motor 56 to move the carriage 2 in the scanning direction, while controlling the actuator 14 so as to jet the ink(s) from the nozzles 10 toward the recording paper P, thereby performing the recording on the recording paper P. Note that during the printing, the controller 50 causes the electric power source circuit 49 to generate the driving voltage Va determined in S411.

Further, during the printing in S415, the controller 50 controls the carriage motor 56 every time the pass operation is performed for a predetermined count Na so as to move the carriage to the flushing position, and controls the actuator 14 so as to perform a during-print flushing operation for causing the ink to be jetted from the nozzles 10. With this, it is possible to discharge, at an intermediate point of time in the printing (during the printing), a highly viscous ink inside the nozzles 10. In the above-described S414, the count Na is determined as the frequency at which the during-print flushing operation is to be performed. Specifically, as the supply evaporation rate Dp is higher, the predetermined count Na is determined as a smaller count.

Then, after the completion of the printing, in a case that the flag of a moisture-retention flushing operation is set (S416: YES), the controller 50 controls the carriage motor 56 so as to move the carriage 2 to the maintenance position, and controls the actuator 14 so as to perform a moisture-retention flushing operation (corresponding to a "post-jetting flushing operation" of the present teaching) for causing the ink to be discharged from the nozzles 10 toward the cap 21 (S417). Here, in the moisture-retention flushing operation, the discharge amount of the ink from the nozzles 10 is made to be smaller than those in the above-described sedimentation purge operation and pre-print purge operation. Further, due to the moisture-retention flushing performed as described above, the cap evaporation rate Dc is lowered. Provided that the state of the cap 21 is switched to the capping state in a state that the cap evaporation rate Dc is high, the movement of the water content described above is advanced, which in turn easily increase the nozzle evaporation rate Dn. In view of such a situation, by performing the moisture-retention flushing operation after the printing in a case that the cap evaporation rate Dc is high and then the state of the cap 21 is switched to the capping state, it is possible to suppress any increase in the nozzle evaporation rate Dn which would be otherwise caused by the above-described movement of the water content.

Note that the reason for performing the moisture-retention flushing operation after the printing, rather than before the printing, is as follows. Namely, in a case that the moisture-retention flushing operation is performed before the printing, the state of the cap 21 is switched to the uncapping state during the printing, and the water content is evaporated from the ink inside the cap 21 in this situation. Accordingly, if the moisture-retention flushing operation is performed before the printing, a part or portion of the water content supplied by the moisture-retention flushing operation is wasted uselessly.

Then, after the moisture-retention flushing operation, the controller 50 resets the cap evaporation rate Dc to the initial value Dc0 (S418), and then controls the cap ascending/descending mechanism 58 so as to ascend the cap 21 to thereby switch the state of the cap 21 to the capping state (S419). On the other hand, in a case that the flag of the moisture-retention flushing operation is not set (S416: NO), the controller 50 switches the state of the cap 21 to the capping state (S419), without performing the moisture-retention flushing operation and the resetting of the cap evaporation rate Dc.

In the embodiment as explained above, the degree or extent of the increase in the viscosity of the ink inside the ink-jet head 3, due to the sedimentation of the pigment particles, becomes greater as the viscosity Ws of the ink inside the sub tank 15 is higher and as the supply evaporation rate Dp is higher, but irrelevant to the cap evaporation rate Dc. In view of this, in the present embodiment, the viscosity Wn of the ink inside the ink-jet head 3 is obtained based on the viscosity Ws of the ink inside the sub tank 15 and the supply evaporation rate Dp, but irrelevant to the cap evaporation rate Dp, as described above. Then, the determination as to whether or not the sedimentation purge operation is to be performed and the determination of the sedimentation purge amount are performed based on the viscosity Wn. With this, it is possible to appropriately perform the determination as to whether the sedimentation purge operation is to be performed and the determination of the sedimentation purge amount, based on the degree or extent of the sedimentation of the pigment particles in the ink inside the ink-jet head 3.

Further, the nozzle evaporation rate Dn at a time before the printing is performed changes depending on the supply evaporation rate Dp. Furthermore, in a case that the state of the cap 21 is in the capping state, the nozzle evaporation rate Dn is increased due to the above-described movement of the water content. Moreover, as the cap evaporation rate Dc is higher, the movement of the water content is advanced, thereby increasing the nozzle evaporation rate Dn. In view of this, in the present embodiment, the nozzle evaporation rate Dn is obtained based on both of the supply evaporation rate Dp and the cap evaporation rate Dc, as described above. Then, it is determined as to whether or not the pre-print purge operation is to be performed, based on the nozzle evaporation rate Dn. With this, it is possible to appropriately perform the determination as to whether or not the pre-print purge operation is to be performed, based on the degree or extent of the increase in the viscosity of the ink inside the nozzles 10, at a time before performing the printing, while considering the above-described movement of the water content.

Further, in the pre-print flushing operation, in a case that the degree of the increase in the viscosity of the ink inside the nozzles 10 is great, it is necessary to increase the driving voltage Vb generated in the electric power source circuit 49 to be high, for the purpose of discharging a highly viscous ink inside the nozzles 10, thereby increasing the jetting energy which is generated when the actuator 14 is driven and which is to be applied to the ink inside the ink-jet head 3. On the other hand, in a case that the nozzle evaporation rate Dn is high and/or in a case that the temperature U is low, the extent of the increase in the viscosity of the ink inside the nozzles 10 becomes great. Furthermore, the nozzle evaporation rate Dn changes depending on both of the supply evaporation rate Dp and the cap evaporation rate Dc, as described above. In view of this situation, the present embodiment determines the driving voltage Vb, which is generated by the electric power source circuit 49 in a case that the pre-print flushing operation is to be performed, based on the temperature U and based on the nozzle evaporation rate Dn which is obtained based on the supply evaporation rate Dp and the cap evaporation rate Dc as described above. By doing so, the driving voltage Vb can be made an appropriate voltage which is determined in accordance with the degree of increase in the viscosity of the ink inside then nozzles 10, while considering the above-described movement of the water content.

Moreover, during the printing, it is necessary that the frequency at which the during-print flushing operation is performed is made to be higher as the viscosity of the ink inside the ink-jet head 3 is higher. On the other hand, during the printing, the state of the cap 21 is in the uncapping state. Accordingly, the viscosity of the ink inside the ink-jet head 3 during the printing changes depending on the supply evaporation rate Dp and the temperature U, but irrelevant to the cap evaporation rate Dc. In view of this, in the present embodiment, the frequency of the during-print flushing (count Na) is determined based on the supply evaporation rate Dp and the temperature U, but regardless of (irrelevant to) the cap evaporation rate Dc. With this, it is possible to perform the during-print flushing operation at an appropriate frequency in accordance with the viscosity of the ink inside the nozzles 10 during the printing.

Further, the moisture-retention flushing operation is performed for the purpose of lowering the cap evaporation rate Dc. Accordingly, in the present embodiment, the determination as to whether or not the moisture-retention flushing operation is to be performed (whether or not the flag of the moisture-retention flushing operation is to be set) based on the cap evaporation rate Dc, but irrelevant to the supply evaporation rate Dp, as described above. With this, in a case that the cap evaporation rate Dc becomes high, the moisture-retention flushing operation can be performed appropriately.

In such a manner, the present embodiment performs the control in each of the pre-print purge operation and the pre-print flushing operation based on both of the supply evaporation rate Dp and the cap evaporation rate Dc. Further, the present embodiment performs the control in each of the sedimentation purge operation and the during-print flushing operation, based only the supply evaporation rate Dp among the supply evaporation rate Dp and the cap evaporation rate Dc. Furthermore, the present embodiment performs the control in the moisture-retention flushing operation, based only the cap evaporation rate Dc among the supply evaporation rate Dp and the cap evaporation rate Dc. Accordingly, in these controls, it is possible to suppress such a situation that the purge operation and/or the flushing operation as described above is/are performed unnecessarily and/or that the ink is discharged in an amount greater than as required in the purge operation and/or the flushing operation, as compared with such a case in which any attempt is made to perform these controls uniformly based on both of the supply evaporation rate Dp and the cap evaporation rate Dc, uniformly based only on the supply evaporation rate Dp, or uniformly based only on the cap evaporation rate Dc.

Note that in the present embodiment, the pre-print purge operation and the pre-print flushing operation each correspond to a "first discharging operation" of the present teaching, and the sedimentation purge operation, the during-print flushing operation and the moisture-retention flushing operation each correspond to a "second discharging operation" of the present teaching. Further, in the present embodiment, the maintenance unit 8 configured to cause the ink to be discharged from the nozzles 10 in the sedimentation purge operation and the pre-print purge operation corresponds to a "purge mechanism" of the present teaching. Furthermore, the maintenance unit 8 (purge mechanism), and the actuator 14 configured to cause the ink to be discharged from the nozzles 10 in the pre-print flushing operation, the during-print flushing operation and the moisture-retention flushing operation each correspond to a "discharging section" of the present teaching.

Further, in the present embodiment, corresponding to the configuration wherein the ink is supplied from the ink cartridge 32 to the sub tank 15, the supply evaporation rate Dp is calculated as an evaporation rate in accordance with the evaporation rate of the water content in the ink inside the supply channel 15*a* and the evaporation rate of the water content in the ink inside the ink cartridge 32. With this, it is possible to perform the control regarding the discharging operation based on the supply evaporation rate DP more appropriately than in a case wherein the supply evaporation rate Dp is calculated as the evaporation rate of the water content in the ink inside the supply channel 15*a* without considering the evaporation rate of the water content of the ink inside the ink cartridge 32.

Furthermore, in the present embodiment, the descending order of the discharge amount of the ink from the nozzles 10 is: the sedimentation purge operation, the pre-print purge operation and the moisture-retention flushing operation. In view of this, in the present embodiment, it is determined firstly as to whether or not the sedimentation purge operation is to be performed (S403), among the three operations. Then, in a case that the sedimentation purge operation is not to be performed (S403: NO), in the present embodiment, it is determined as to whether or not the pre-print purge operation is to be performed (S406). Moreover, in the present embodiment, whether or not the moisture-retention flushing operation is to be performed is determined (S416) regardless of whether or not either one of the sedimentation purge operation and the pre-print purge operation has been performed. However, in a case that either one of the sedimentation purge operation and the pre-print purge operation has been performed, the cap evaporation rate Dc is reset to the initial value Dc0 (S404(S505), S407(S604)) as described above, and becomes to be not more than the threshold value Dc1, consequently not satisfying the moisture-retention flushing condition. Accordingly, whether or not the moisture-retention flushing operation in S413 is to be performed is determined substantially in a case that neither the sedimentation purge operation nor the pre-print purge operation has been performed.

Namely, in the present embodiment, whether or not a certain operation, among the three operations which are: the sedimentation purge operation, the pre-print purge operation and the moisture-retention flushing operation, is to be performed is determined in the descending order of the discharge amount of the ink from the nozzles 10; in a case that it is determined to perform the certain operation among the above-described three operations, another or other operation(s) which is (are) different from the certain operation and in which the discharge amount of the ink from the nozzles 10 is smaller than the certain operation, is (are) not allowed to be performed.

Here, contrary to the present embodiment, such a situation is considered that whether or not the certain operation among the three operations is to be performed is determined in the ascending order of the discharge amount of the ink from the nozzles 10. In such a situation, even if it is determined that a certain operation is to be performed, there is such a case that another operation, of which discharge amount of the ink from the nozzles 10 is greater than that in the certain operation, further needs to be performed in some cases. Further, in such a case, since both of the operation of which discharge amount of the ink from the nozzles 10 is small and the another operation of which discharge amount of the ink from the nozzles 10 is great are performed, the total amount of the ink discharged from the nozzles 10 becomes consequently great.

In contrast, in the present embodiment, in a case that a certain operation in which the discharge amount of the ink from the nozzles 10 is great is performed, there is normally no need to perform another or other operation(s) which is (are) different from the certain operation and in which the discharge mount of the ink from the nozzles 10 is smaller than the certain operation, as described above. Accordingly, it is possible to make the total amount of the ink discharged from the nozzles 10 to be smaller as compared with the situation as considered above.

Further, in the pass operation during the printing, in a case that the degree of increase in the viscosity of the ink inside the nozzles 10 of the ink-jet head 3 is great, it is necessary to increase the driving voltage Va generated in the electric power source circuit 49 to be high, for the purpose of discharging the ink from the nozzles 10 in a desired amount, thereby increasing the jetting energy which is generated when the actuator 14 is driven and which is to be applied to the ink inside the ink-jet head 3. On the other hand, since the state of the cap 21 is in the uncapping state during the printing, the above-described movement of the water content does not occur, and the viscosity of the ink inside the ink-jet head 3 at the time of the printing (during the printing) is determined by the supply evaporation rate Dp, regardless of the cap evaporation rate Dc. In view of this situation, the present embodiment determines the driving voltage Va, which the electric power source circuit 49 is caused to generate during the printing, in accordance with the viscosity Wn obtained based on the supply evaporation rate Dp and based on the temperature U, regardless of the cap evaporation rate Dc, as described above. With this, it is possible to make the driving voltage Va to be an appropriate voltage in accordance with the viscosity of the ink inside the ink-jet head 3.

Although the embodiment of the present teaching has been explained above, the present teaching is not limited to or restricted by the above-described embodiment; various kinds of change may be made in the above-described embodiment without departing from those described in the claims and the gist and/or scope of the present teaching.

In the above-described embodiment, although the driving voltage Va, which the electric power source circuit 49 is caused to generate during the printing, is determined in accordance with the viscosity Wn obtained based on the supply evaporation rate Dp and based on the temperature U, there is no limitation to this. For example, it is allowable that the driving voltage Va, which the electric power source circuit 49 is caused to generate during the printing, is determined in accordance with the viscosity Wn, regardless of the temperature U. Alternatively, it is allowable that the driving voltage Va, which the electric power source circuit 49 is caused to generate during the printing, is made to be a constant voltage, regardless of the viscosity Wn.

Further, in the embodiment, the driving voltage Vb, which the electric power source circuit 49 is caused to generate during the pre-print flushing operation, is determined based on the nozzle evaporation rate Dn and based on the temperature U, there is no limitation to this. For example, it is allowable that the driving voltage Vb, which the electric power source circuit 49 is caused to generate during the pre-print flushing operation, is determined based on the nozzle evaporation rate Dn, regardless of the temperature U.

Furthermore, in the embodiment, the driving voltages Va and Vb are determined, and the electric power source circuit 49 is caused to generate the determined driving voltages Va and Vb respectively during printing and when performing the pre-print flushing operation. However, there is no limitation to this. For example, it is allowable, for example, that when performing the printing and the pre-print flushing operation, an electric current flowing through the actuator 14 is changed by controlling the electric power source circuit 49 in a manner different from changing the driving voltage to be generated. Alternatively, it is allowable, for example, that the ink-jet head 3 has a circuit, etc., which is connected to the actuator 14 and to the electric power source circuit 49, and that the controller 50 controls this circuit, etc. (controls the ink-jet head 3) so as to change the electric current flowing through the actuator 14 during the printing and the pre-print flushing operation.

Moreover, in the embodiment, although whether or not the certain operation among the three kinds of operation, which are: the sedimentation purge operation, the pre-print purge operation and the moisture-retention flushing operation, is to be performed is determined in the descending order of the discharge amount of the ink from the nozzles 10, there is no limitation to this. Whether or not these three kinds of operation are to be performed may be determined in an order different from the order in the above-described embodiment.

Further, in the embodiment, although the determination as to whether or not the sedimentation purge operation is to be performed and the determination of the sedimentation purge amount are performed based on the viscosity Wn of the ink inside the ink-jet head 3 which is obtained based on the supply evaporation rate Dp, there is no limitation to this. For example, it is allowable that whether or not the sedimentation purge operation is to be performed is determined based on the viscosity Wn, and that the sedimentation purge amount is made constant regardless of the viscosity Wn.

Furthermore, in the embodiment, whether or not the pre-print purge operation is to be performed is determined based on the nozzle evaporation rate Dn which is determined based on both of the supply evaporation rate Dp and the cap evaporation rate Dc, and the purge amount in the pre-print purge operation is made to be the purge amount E0 which is a constant amount. However, it is allowable that the purge amount in the pre-print purge operation is made to be different depending on the nozzle evaporation rate Dn.

Moreover, in the embodiment, whether or not the moisture-retention flushing operation is to be performed is determined based on the cap evaporation rate Dc. It is allowable, however, that the discharge amount of the ink from the nozzles 10 in the moisture-retention flushing operation is further determined based on the cap evaporation rate Dc.

Further, it is allowable that also regarding the pre-print flushing operation, the discharge amount of the ink from the nozzles 10 in the pre-print flushing operation is further determined based on the nozzle evaporation rate Dn which is determined based on both of the supply evaporation rate Dp and the cap evaporation rate Dc.

Furthermore, in the above-described embodiment, although the ink is jetted toward the flushing foam 7 from the nozzles 10 in the pre-print flushing operation and the during-print flushing operation, there is no limitation to this. It is allowable that the printer 1 is not provided with the flushing foam 7 and that the ink is jetted toward the cap 21 from the nozzles 10 in each of the pre-print flushing operation and the during-print flushing operation. Moreover, in such a case, since the cap evaporation rate is lowered due to the pre-print flushing operation, the during-print flushing operation and the moisture retention flushing operation it is allowable that the jetting amount of the ink from the nozzles 10 in the moisture-retention flushing operation is made to be smaller than that in the embodiment.

Furthermore, the embodiment is configured such that the two kinds of the purge operation, namely, the sedimentation purge operation and the pre-print purge operation can be performed as the purge operation which is to be performed before the printing. However, there is no limitation to this. For example, in such a case that the ink is an ink by which no sedimentation of the pigment in the ink does not occur, and which is exemplified by a dye ink, etc., it is allowable to provide a configuration wherein only the pre-print purge operation can be performed as the purge operation which is to be performed before the printing.

Moreover, in the embodiment, although the pre-print purge operation and the pre-print flushing operation are performed as the first discharging operation, and the sedimentation purge operation, the during-print flushing operation and the moisture-retention flushing operation are performed as the second discharging operation. However, there is no limitation to this. For example, provided that at least one of the operations listed as the first discharging operation is included, and that at least one of the operations listed as the second discharging operation is included, only a part of each of these discharging operations may be performed. Further, the discharging operations performed as the first discharging operation, and the discharging operations performed as the second discharging operation may each include a discharging operation which is different from those explained in the above.

For example, in a case that the receptacle of the printer is connected to the power supply source after the printer has been left untouched (deactivated) for a long period of time in a state that the receptacle has been disconnected, it is allowable that the suction purge is performed before the printing so as to perform, as the second discharging operation, a discharging operation for causing all the highly viscous ink inside the ink-jet head 3, the sub tank 15 and the tubes 31 to be discharged therefrom. The viscosity of the ink inside the ink-jet head 3, the sub tank 15 and the tubes 31 after having been left deactivated for a long period of time with the receptacle being unplugged is a viscosity in accordance with the supply evaporation rate Dp, and is not related to the cap evaporation rate Dc. Accordingly, in this discharging operation, the suction pump 23 is driven based only on the supply evaporation rate Dp among the supply evaporation rate Dp and the cap evaporation rate Dc, to thereby perform the suction purge. Note that in this discharging operation, the discharge amount of the ink is further greater than the above-described sedimentation purge operation.

Further, in the embodiment, the explanation has been given about the case in which the control is performed while considering the change in the viscosity of the ink inside the nozzles 10 due to the movement of the water content from the ink inside the nozzles 10 to the ink inside the cap 21 due to the water content absorbed by the humectant in the ink inside the cap 21, the change in the viscosity of the ink inside the nozzles 10, due to the movement of the water content from the ink inside the nozzles 10 to the ink inside the cap 21, is not limited to this.

For example, in a printer in which humidified air is supplied to a space inside a cap in a state that the cap is in the capping state, as described in Japanese Patent Application Laid-open No. 2015-63076, the water content is moved from the ink inside the cap to the ink inside the nozzles, in some cases. In the printer having such a configuration, it is allowable to perform the control regarding the discharging operation such as the purge, flushing, etc., while considering the movement of the water content from the ink inside the cap to the ink inside the nozzles.

Further, in the above-described embodiment, the explanation has been given about the example in which the control is performed, in the first discharging operation, based on both of the supply evaporation rate Dp and the cap evaporation rate Dc for the purpose of considering the change in the viscosity of the ink inside the nozzles 10 due to the movement of the water content between the ink inside the nozzles and the ink inside the cap, and in which the control is performed, in the second discharging operation, based on only one of the supply evaporation rate Dp and the cap evaporation rate Dc, while not considering the change in the viscosity of the ink inside the nozzles 10 due to the above-described movement of the water content. However, there is no limitation to this. It is also allowable to provide a configuration capable of performing a first discharging operation wherein the control is performed base on both of the supply evaporation rate Dp and the cap evaporation rate Dc, regardless of the movement of the water content between the ink inside the nozzles and the ink inside the cap, and a second discharging operation wherein the control is performed based on only one of the supply evaporation rate Dp and the cap evaporation rate Dc.

Further, in the above-described embodiment, although the suction purge is performed to thereby cause the ink inside the ink-jet head 3 to be discharged from the nozzles 10, there is no limitation to this. For example, it is allowable that a pump configured to feed an ink is provided on a channel between the ink cartridges 32 and the ink-jet head 3, such as the tubes 31, and that the pump is driven in a state that the cap 21 is in the capping state to thereby perform a pressure purge for causing the ink inside the ink-jet head 3 to be discharged from the nozzles 10. In such a case, the cap 21 and the above-described pump correspond to the "purge mechanism" of the present teaching. Alternatively, it is also allowable that both the suction purge and the pressure purge are performed to thereby allow the ink inside the ink-jet head 3 to be discharged from the nozzles 10. In such a case, the maintenance unit 8 and the pump provided on the tubes 31, etc., collectively correspond to the "purge mechanism" of the present teaching.

Furthermore, in the embodiment, although the tank as the supply source of the ink is the ink cartridge, there is no limitation to this. For example, the tank as the supply source of the ink may be an ink storing bag of a pouch type formed of a flexible resin. A cap to which the tube 31 is connectable is provided on the ink storing bag; in a case that the tube 31 is connected to this cap, the ink inside the ink storing bag is supplied to the sub tank 15 via the tube 31.

Since a space in the pouch-type ink storing bag in which the ink is stored is sealed, the water content hardly evaporates in the ink inside the ink storing bag. Accordingly, in this case, the supply evaporation rate Dp may be calculated as an evaporation rate depending on the evaporation of the water content of the ink inside the supply channel 15*a*, without considering the evaporation of the water content in the ink inside the ink storing bag.

Further, although the embodiment is configured such that the ink is supplied to the sub tank 15 from the ink cartridge 32 which is detachably installed in the cartridge installing section 33, there is no limitation to this. It is allowable to provide such a configuration that the ink is supplied to the sub tank 15 from an ink tank which is formed of a hard resin and which is fixed to the casing of the printer 1. This ink tank has a supplementing port which is formed therein and via which the ink tank is supplemented with the ink. A user is capable of inserting a supply port of a bottle storing the ink into the supplementing port and by pressing the bottle, thereby making it possible to supplement the ink tank with the ink from the bottle via the supplementing port.

In this case, the user can supplement the ink tank with ink at any timing. Accordingly, it is difficult to correctly grasp the evaporation rate of the water content in the ink inside the ink tank. Therefore, in this case, it is allowable to calculate the supply evaporation rate Dp as an evaporation rate based on the evaporation rate of the water content in the ink inside the supply channel 15*a*, without considering the evaporation rate of the water content in the ink inside the ink tank.

Further, even in a case that the ink is supplied to the sub tank 15 from the ink cartridge 32 as in the above-described embodiment, it is allowable to calculate the supply evaporation rate Dp as an evaporation rate which is in accordance with the evaporation rate of the water content in the ink inside the supply channel 15*a*, without considering the evaporation rate of the water content in the ink inside the ink tank. The supply evaporation rate Dp may be calculated in the above-described manner, for example, in such a case that the evaporation of the water content in the ink inside the ink cartridge 32 is less likely to occur as compared with the evaporation of the water content of the ink inside the supply channel 15*a*.

Further, although the above-described embodiment is configured such that the state of the cap 21 can be switched between the capping state and the uncapping state by ascending/descending the cap 21 by the cap ascending/descending mechanism 58 in a state that the carriage 2 is located at the maintenance position, there is no limitation to this. For example, it is allowable that a head ascending/descending mechanism configured to ascend/descend the ink-jet head 3 is provided, instead of providing the cap ascending/descending mechanism 58, and that the state of the cap 21 can be switched between the capping state and the uncapping state by ascending/descending the ink-jet head 3 by the head ascending/descending mechanism. Note that in this case, the head ascending/descending mechanism corresponds to the "switching mechanism" of the present teaching. Alternatively, it is also allowable that both a cap ascending/descending mechanism and the head ascending/descending mechanism are provided, and that the state of the cap 21 can be switched between the capping state and the uncapping state by performing both the ascendance/descendance of the cap 21 by the cap ascending/descending mechanism and the ascendance/descendance of the ink-jet head 3 by the head ascending/descending mechanism. Note that in this case, the cap ascending/descending mechanism and the head ascending/descending mechanism collectively correspond to the "switching mechanism" of the present teaching.

Further, in the description above, the explanation has been given about the example in which the present teaching is applied to the printer provided with a so-called serial head configured to jet an ink(s) from a nozzle(s) while moving in the scanning direction. However, the example to which the present teaching is applicable is not limited to this. The present teaching is applicable also to a printer provided with a so-called line printer extending over the entire length in the scanning direction of a recording paper (recording paper sheet, recording sheet). Further, the present teaching is not also limited as being applied to a printer configured to jet an ink from a nozzle so as to perform printing. For example, the present teaching is applicable also to a liquid jetting apparatus configured to jet a liquid different from the ink(s), such as a material of a wiring pattern to be printed on a wiring board (liquid for a pattern material).

What is claimed is:

1. A liquid jetting apparatus comprising:

a liquid jetting head including a nozzle;

a supply channel connected to the liquid jetting head to supply liquid to the nozzle;

a cap configured to cover the nozzle;

a discharging section configured to cause the liquid to be discharged from the nozzle;

a switching mechanism configured to perform switching of a state of the cap between a capping state in which the cap is in contact with the liquid jetting head to cover the nozzle and an uncapping state in which the cap is apart from the liquid jetting head; and a controller configured to perform:

a first discharge operation in which the controller controls the discharging section to cause the liquid to be discharged from the nozzle, based on both of a supply evaporation rate and a cap evaporation rate, the supply evaporation rate relating to an evaporation rate of a water content in the liquid inside the supply channel, and the cap evaporation rate being an evaporation rate of the water content in the liquid discharged into the cap and remaining in the cap; and a second discharge operation in which the controller controls the discharging section to cause the liquid to be discharged from the nozzle, based on either one of the supply evaporation rate and the cap evaporation rate, wherein the controller is configured to select one of the first discharge operation and the second discharge operation in response to whether a certain condition is satisfied or not.

2. The liquid jetting apparatus according to claim 1, further comprising a liquid cartridge connected to the supply channel, the liquid cartridge configured to store the liquid therein, wherein the supply evaporation rate relates to both an evaporation rate of the water content in the liquid inside the supply channel and an evaporation rate of the water content in the liquid inside the liquid cartridge.

3. A liquid jetting apparatus comprising:

a liquid jetting head including a nozzle;

a supply channel connected to the liquid jetting head to supply liquid to the nozzle;

a cap configured to cover the nozzle;

a discharging section configured to cause the liquid to be discharged from the nozzle;

a switching mechanism configured to perform switching of a state of the cap between a capping state in which the cap is in contact with the liquid jetting head to cover the nozzle and an uncapping state in which the cap is apart from the liquid jetting head; and a controller configured to perform:

controlling the discharging section to cause the liquid to be discharged from the nozzle, based on both of a supply evaporation rate and a cap evaporation rate, the supply evaporation rate relating to an evaporation rate of a water content in the liquid inside the supply channel, and the cap evaporation rate being an evaporation rate of the water content in the liquid discharged into the cap and remaining in the cap; and controlling the discharging section to cause the liquid to be discharged from the nozzle, based on one of the supply evaporation rate and the cap evaporation rate, wherein in a case that the controller controls the discharging section to cause the liquid to be discharged from the nozzle based on both of the supply evaporation rate and the cap evaporation rate, the controller controls the discharging section based on a change in a viscosity of the liquid inside the nozzle due to movement of the water content between the liquid inside the nozzle and the liquid inside the cap in the capping state, and in a case that the controller controls the discharging section to cause the liquid to be discharged from the nozzle based on one of the supply evaporation rate and the cap evaporation rate, the controller controls the discharging section, not based on the change in the viscosity of the liquid inside the nozzle due to the movement of the water content.

4. The liquid jetting apparatus according to claim 3, further comprising a power source circuit configured to generate a driving voltage for driving the liquid jetting head, wherein the discharging section includes an actuator configured to impart a jetting energy to the liquid for jetting the liquid from the nozzle, and in the case that the controller controls the discharging section to cause the liquid to be discharged from the nozzle based on both of the supply evaporation rate and the cap evaporation rate, the controller controls the actuator to perform a pre-jetting flushing for jetting the liquid from the nozzle, before controlling the actuator to jet the liquid from the nozzle toward a medium.

5. The liquid jetting apparatus according to claim 4, wherein in a case that the controller controls the liquid jetting head to perform the pre-jetting flushing based on both of the supply evaporation rate and the cap evaporation rate, the controller is configured to determine as to whether the power source circuit is caused to generate a first driving voltage or a second driving voltage being higher than the first driving voltage.

6. The liquid jetting apparatus according to claim 5, wherein in a case that the controller controls the actuator to jet the liquid from the nozzle toward the medium based on the supply evaporation rate, the controller is configured to determine as to whether the power source circuit is caused to generate the first driving voltage or the second driving voltage.

7. The liquid jetting apparatus according to claim 3, wherein the discharging section includes a purge mechanism configured to cause the liquid inside the liquid jetting head to be discharged in a state that the cap is in the capping state, and in the case that the controller controls the discharging section to cause the liquid to be discharged from the nozzle based on both of the supply evaporation rate and the cap evaporation rate, the controller controls the purge mechanism to perform a pre-jetting purge for causing the liquid inside the liquid jetting head to be discharged, before jetting the liquid from the nozzle toward a medium.

8. The liquid jetting apparatus according to claim 7, wherein the liquid contains pigment particles, in the case that the controller controls the discharging section to cause the liquid to be discharged from the nozzle based on one of the supply evaporation rate and the cap evaporation rate, the controller controls the purge mechanism to perform a sedimentation purge for causing the liquid in which the pigment particles are sediment to be discharged from the nozzle, before jetting the liquid from the nozzle toward a medium, an amount of the liquid discharged in the sedimentation purge is greater than an amount of the liquid discharged in the pre-jetting purge, and in a case that the controller controls the purge mechanism to perform the sedimentation purge, the controller controls the purge mechanism based on the supply evaporation rate.

9. The liquid jetting apparatus according to claim 7, wherein the purge mechanism includes:

the cap; and a suction pump connected to the cap, the suction pump being controlled by the controller.

10. The liquid jetting apparatus according to claim 3, wherein the discharging section includes an actuator configured to impart a jetting energy to the liquid inside the nozzle, in the case that the controller controls the discharging section to cause the liquid to be discharged from the nozzle based on one of the supply evaporation rate and the cap evaporation rate, the controller controls the actuator to perform a during-jetting flushing for jetting the liquid from the nozzle, while the controller is controlling the actuator to jet the liquid from the nozzle toward a medium, and in a case that the controller controls the actuator to perform the during-jetting flushing, the controller controls the actuator based on the supply evaporation rate.

11. The liquid jetting apparatus according to claim 3, wherein the discharging section includes an actuator configured to impart a jetting energy to the liquid for jetting the liquid from the nozzle, in the case that the controller controls the discharging section to cause the liquid to be discharged from the nozzle based on one of the supply evaporation rate and the cap evaporation rate, the controller controls the actuator to perform a post-jetting flushing for jetting the liquid from the nozzle toward the cap, after controlling the actuator to jet the liquid from the nozzle toward a medium, and in a case that the controller controls the actuator to perform the post-jetting flushing, the controller controls the actuator based on the cap evaporation rate.

12. The liquid jetting apparatus according to claim 3, wherein in the case that the controller controls the discharging section to cause the liquid to be discharged from the nozzle based on both of the supply evaporation rate and the cap evaporation rate, the controller is configured to perform at least one of determination as to whether or not to control the discharging section to cause the liquid to be discharged from the nozzle and determination of an amount of the liquid to be discharged from the nozzle, based on the change in the viscosity of the liquid inside the nozzle due to the movement of the water content, and in the case that the controller controls the discharging section to cause the liquid to be discharged from the nozzle based on one of the supply evaporation rate and the cap evaporation rate, the controller is configured to perform the at least one of the determination, not based on the change in the viscosity of the liquid inside the nozzle due to the movement of the water content.

13. The liquid jetting apparatus according to claim 12, wherein the discharging section includes:

an actuator configured to impart a jetting energy to the liquid inside the nozzle; and a purge mechanism configured to cause the liquid inside the liquid jetting head to be discharged in the capping state, the liquid contains pigment particles, in a case that the controller controls the discharging section to cause the liquid to be discharged from the nozzle based on both of the supply evaporation rate and the cap evaporation rate, the controller controls the purge mechanism to perform a pre-jetting purge for causing the liquid inside the liquid jetting head to be discharged, before controlling the actuator to jet the liquid from the nozzle toward a medium, in a case that the controller controls the discharging section to cause the liquid to be discharged from the nozzle based on one of the supply evaporation rate and the cap evaporation rate, the controller controls the purge mechanism to perform a sedimentation purge for causing the liquid in which the pigment particles are sediment to be discharged from the nozzle, before controlling the actuator to jet the liquid from the nozzle toward the medium, an amount of the liquid discharged from the liquid jetting head in the sedimentation purge being greater than an amount of the liquid jetted from the liquid jetting head in the pre-jetting purge, and the controller controls the actuator to perform a post-jetting flushing for jetting the liquid from the nozzle toward the cap, after controlling the actuator to jet the liquid from the nozzle toward the medium, an amount of the liquid jetted from the liquid jetting head in the post-jetting flushing being smaller than the amount of the liquid discharged from the liquid jetting head in the pre-jetting purge, and the controller determines as to whether or not the sedimentation purge is to be performed, based on the supply evaporation rate, under a condition that the controller determines that the sedimentation purge is not to be performed, the controller determines as to whether or not the pre-jetting purge is to be performed, based on both of the supply evaporation rate and the cap evaporation rate, and under a condition that the controller determines that the pre-jetting purge is not to be performed, the controller determines as to whether or not the post-jetting flushing is to be performed, based on the cap evaporation rate.

* * * * *